US008695383B2

(12) United States Patent
Erickson et al.

(10) Patent No.: US 8,695,383 B2
(45) **Date of Patent: *Apr. 15, 2014**

(54) LAUNDRY TREATING APPLIANCE WITH BALANCING SYSTEM

(75) Inventors: Donald E. Erickson, Stevensville, MI (US); Farshad Farid, Stevensville, MI (US); Dennis L. Kehl, Benton Harbor, MI (US); Vishal Verma, Portage, IN (US)

(73) Assignee: Whirlpool Corporation, Benton Harbor, MI (US)

( * ) Notice: Subject to any disclaimer, the term of this patent is extended or adjusted under 35 U.S.C. 154(b) by 458 days.

This patent is subject to a terminal disclaimer.

(21) Appl. No.: 12/963,145

(22) Filed: Dec. 8, 2010

(65) Prior Publication Data

US 2012/0144880 A1 Jun. 14, 2012

(51) Int. Cl.
*D06F 29/00* (2006.01)

(52) U.S. Cl.
USPC ..... 68/23.2

(58) Field of Classification Search
USPC ..... 68/12.06, 23.1, 23.2, 23.4
See application file for complete search history.

(56) References Cited

U.S. PATENT DOCUMENTS

| | | | |
|---|---|---|---|
| 3,760,613 | A | 9/1973 | Henderson |
| 3,800,567 | A | 4/1974 | Stelwagen et al. |
| 5,280,660 | A | 1/1994 | Pellerin et al. |
| 5,345,792 | A | 9/1994 | Farrington et al. |
| 5,548,979 | A | 8/1996 | Ryan et al. |
| 5,582,040 | A | 12/1996 | Khan |
| 5,893,280 | A | 4/1999 | Honda et al. |
| 5,913,951 | A | 6/1999 | Herr et al. |
| 6,129,768 | A | 10/2000 | Johnson et al. |
| 6,463,767 | B2 | 10/2002 | Uzkureit et al. |
| 6,510,715 | B1 | 1/2003 | Simsek |
| 7,096,695 | B2 | 8/2006 | No et al. |
| 7,296,445 | B2 | 11/2007 | Zhang et al. |
| 7,617,705 | B2 | 11/2009 | Chang et al. |
| 7,739,764 | B2 | 6/2010 | Zhang et al. |
| 2004/0083774 | A1 | 5/2004 | Kinouchi et al. |
| 2005/0005651 | A1 | 1/2005 | Kim et al. |
| 2005/0097926 | A1 | 5/2005 | Kim et al. |
| 2005/0210929 | A1 | 9/2005 | George, II et al. |
| 2005/0210930 | A1 | 9/2005 | Contini et al. |
| 2009/0007600 | A1 | 1/2009 | Cimetta et al. |
| 2009/0133447 | A1 | 5/2009 | Yoon et al. |

FOREIGN PATENT DOCUMENTS

| | | | |
|---|---|---|---|
| DE | 4313819 | A1 | 4/1994 |
| EP | 0795639 | A2 | 9/1997 |
| EP | 0856604 | A2 | 8/1998 |
| EP | 1655404 | A1 | 5/2006 |
| EP | 1693500 | A2 | 8/2006 |
| EP | 2039820 | A1 | 3/2009 |
| GB | 737072 | | 9/1955 |

(Continued)

OTHER PUBLICATIONS

German Search Report for DE102011054368, Jul. 4, 2012.

*Primary Examiner* — Michael Barr
*Assistant Examiner* — David Cormier

(57) ABSTRACT

A laundry treating appliance having a drum, defining a treating chamber, with a lifter and a balancing system having at least one balancing ring and a reservoir located in the lifter and a liquid supply system fluidly coupled to the reservoir. Liquid may be supplied to the ring and to the reservoir through the ring to offset an imbalance in a laundry load located within the drum.

8 Claims, 16 Drawing Sheets

(56) References Cited

FOREIGN PATENT DOCUMENTS

| | | | |
|---|---|---|---|
| GB | 877660 | | 9/1961 |
| GB | 1268597 | | 3/1972 |
| GB | 1268597 | A | 3/1972 |
| JP | 2002136792 | A | 5/2002 |
| KR | 20000033920 | A | 6/2000 |
| KR | 20010065836 | A | 7/2001 |
| WO | 2006/063305 | A1 | 6/2006 |
| WO | 2007/077128 | A1 | 7/2007 |
| WO | 2009/027407 | A1 | 3/2009 |
| WO | 2009/083352 | A1 | 7/2009 |

LAUNDRY TREATING APPLIANCE WITH BALANCING SYSTEM

BACKGROUND OF THE INVENTION

Laundry treating appliances, such as clothes washers, refreshers, and non-aqueous systems, may have a rotatable drum defining a treating chamber for treating laundry according to a cycle of operation. For some laundry treating appliances, vibration and noise may be generated from an imbalance in the drum created by unevenly distributed laundry inside the treating chamber. Some laundry treating appliances may include a damping system, such as a suspension system or a balancing system, to reduce vibration and noise generated from the laundry treating appliance during a cycle of operation. In active balancing systems, one or more sensors may be employed to detect imbalances in the drum, and corrective action is taken to balance the drum based on the information from the sensors.

BRIEF DESCRIPTION OF THE INVENTION

The invention relates to a laundry treating appliance having a cabinet defining an interior, a tub located within the interior and defining a liquid-holding chamber, a drum located within the liquid-holding chamber for rotation about a rotational axis and having opposing ends connected by a peripheral side, which collectively at least partially define a treating chamber, at least one lifter provided on the drum and projecting into the treating chamber, and a balancing system. The balancing system includes a balancing ring provided on one of the opposing ends of the drum and having at least one fluid chamber, a liquid supply system provided on the other of the opposing ends of the drum, and a supply conduit extending through the at least one lifter and having a first end fluidly coupled to the liquid supply system and a second end fluidly coupled to the at least one fluid chamber, wherein the second end is radially farther from the rotational axis than the first end such that liquid supplied to the first end will flow toward the second end in response to the centrifugal force applied to the liquid from the rotation of the drum.

DESCRIPTION OF AN EMBODIMENT OF THE INVENTION

Figure 1:
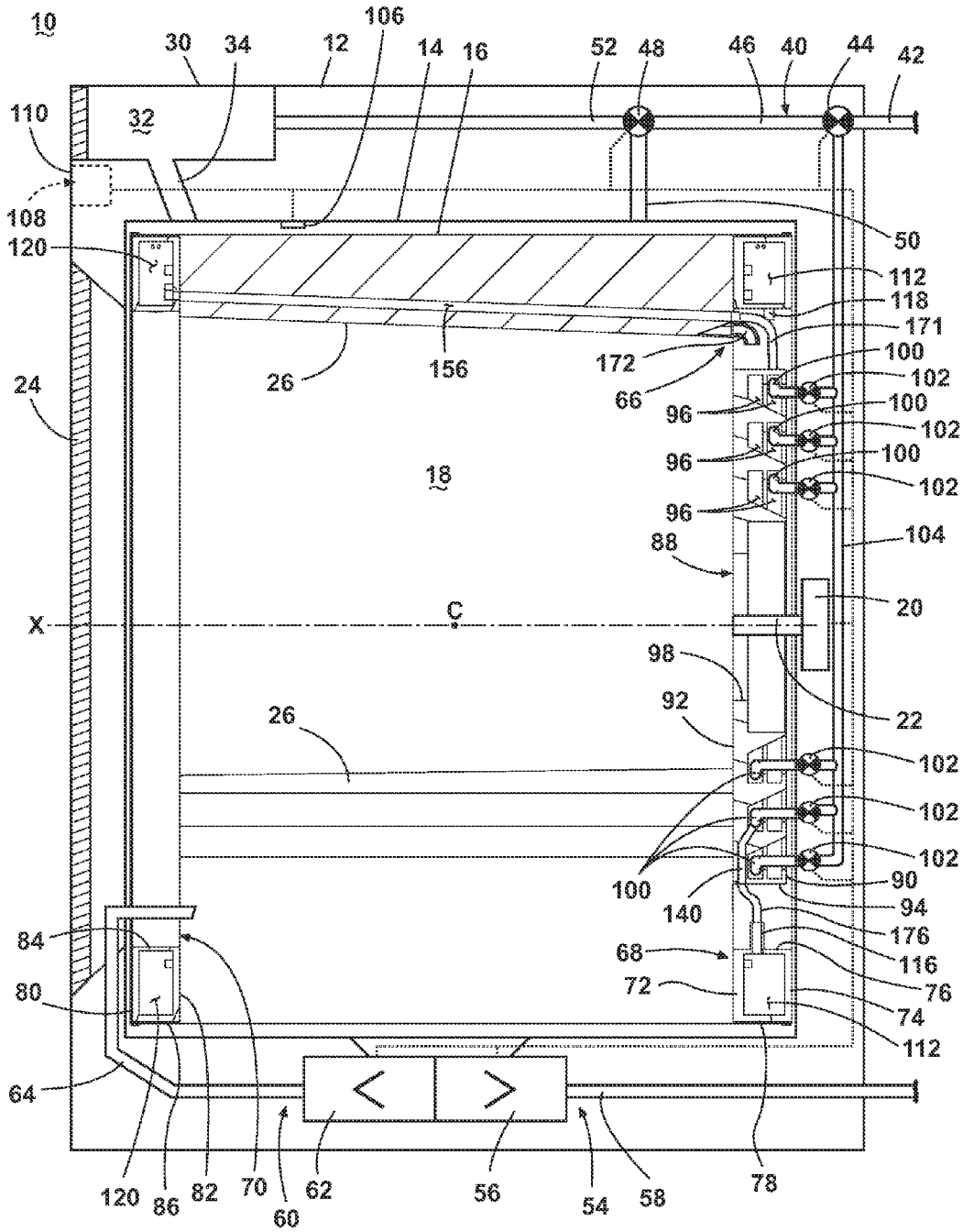
FIG. 1 is a schematic view of a laundry treating appliance according to a first embodiment of the invention, illustrating a drum with a balancing system.

FIG. 1 schematically illustrates a first embodiment of the invention in the environment of a laundry treating appliance, such as a laundry treating appliance in the form of a clothes washing machine 10 comprising a cabinet 12, which may be a housing having a chassis and/or a frame, defining an interior. As illustrated, the laundry treating appliance is a horizontal axis clothes washing machine; however, the laundry treating appliance may be any appliance which performs a cycle of operation on laundry, non-limiting examples of which include a vertical-axis washing machine; a combination washing machine and clothes dryer; a tumbling or stationary refreshing/revitalizing machine; an extractor; and a revitalizing machine. The washing machine 10 described herein shares many features of a traditional automatic clothes washing machine, which will not be described in detail except as necessary for a complete understanding of the invention.

A tub 14 may be provided in the interior of the cabinet 12 and may be configured to hold liquid. As such, the tub 14 defines a liquid-holding chamber. The tub 14 may be supported within the cabinet 12 by a suitable suspension system (not shown). A drum 16 may be provided within the tub 14 and may have an inner periphery at least partially defining a treating chamber 18 for receiving fabric, such as laundry to be treated according to a cycle of operation. The drum 16 may be mounted for rotation within the tub 14 about a rotational axis X. The inner periphery of the drum 16 defines an interior circumference of the drum 16. The drum 16 includes a geometric center C which, in the illustrated embodiment, lies along the rotational axis X of the drum 16. The drum 16 may have perforations that permit the flow of liquid between the drum 16 and the tub 14.

The drum 16 may be coupled with a motor 20 through a drive shaft 22 for selective rotation of the treating chamber 18 during a cycle of operation. It may also be within the scope of the invention for the motor 20 to be coupled with the drive shaft 22 through a drive belt for selective rotation of the treating chamber 18. The motor 20 may rotate the drum 16 at multiple or variable speeds and in opposite rotational directions.

The tub 14 and drum 16 may have aligned openings, which provide access to the treating chamber 18. A door 24 may be provided to selectively close at least one of the aligned openings to selectively provide access to the treating chamber 18. While the illustrated washing machine 10 includes both the tub 14 and the drum 16, with the drum 16 defining the laundry treating chamber 18, it is within the scope of the invention for the washing machine 10 to include only one receptacle, with the receptacle defining the laundry treating chamber for receiving the laundry load to be treated.

At least one lifter 26 may be provided in the drum to facilitate movement of the laundry load within the drum 16 as the drum 16 rotates. The lifter 26 may be provided on the inner periphery of the drum 16. Multiple lifters 26 can be provided; as illustrated, three lifters 26 are provided, although only two lifters 26 are visible in FIG. 1, and are evenly spaced about the inner periphery of the drum 16.

A dispensing system illustrated as a treating chemistry dispenser 30 may be provided within the cabinet 12 and may include at least one treating chemistry reservoir 32. The treating chemistry dispenser 30 may be provided on an exterior or interior of the cabinet 12 and may be immediately accessible by the user or hidden behind a cover or an access panel. One or more treating chemistries may be provided in the treating chemistry reservoir 32 in any desirable configuration, such as a single charge, multiple charge (also known as bulk dispenser), or both. Examples of typical treating chemistries include, without limitation, water, detergent, bleach, fabric softener, and enzymes. An outlet conduit 34 may fluidly couple the treating chemistry dispenser 30 with the tub 14. The outlet conduit 34 may couple with the tub 14 at any suitable location on the tub 14 and is shown as being coupled with a top wall of the tub 14 for exemplary purposes. The treating chemistry that flows from the treating chemistry dispenser 30 through the outlet conduit 34 to the tub 14 typically enters a space between the tub 14 and the drum 16.

A liquid supply system 40 may also be included in the washing machine 10 to supply liquid to both the treating chemistry dispenser 30 and/or the tub 14. More specifically, liquid such as water may be supplied from a water source, such as a household water supply 42, to the washing machine 10 by operation of a valve 44 controlling the flow of liquid through an inlet conduit 46. Another valve 48 may fluidly couple with the inlet conduit 46 and may have two outlets such that it may determine a flow of liquid through a first supply conduit 50 leading to the tub 14 and may determine a flow of liquid through a second supply conduit 52 leading to the treating chemistry dispenser 30.

A liquid drain system 54 may be provided for draining liquid from the treating chamber 18. The liquid drain system 54 may include a drain pump 56 and a drain conduit 58. The drain pump 56 fluidly couples the tub 14 to the drain conduit 58 such that liquid in the tub 14 may be drained via the drain conduit 58. The drain conduit 58 may be coupled with a household drain. The drain pump 56 may be located in a low portion or sump of the tub 14.

A liquid recirculation system 60 may be provided for recirculating liquid to the treating chamber 18. As illustrated, the recirculation system 60 includes a recirculation pump 62 and a spray conduit 64. The recirculation pump 62 may fluidly couple the tub 14 to the spray conduit 64 such that liquid in the tub 14 may be supplied to the spray conduit 64, where it may be sprayed into the treating chamber 18. The recirculation pump 62 may be fluidly coupled to a low portion or sump of the tub 14. The spray conduit 64 may direct the liquid from the recirculation pump 62 into the drum 16 in any suitable manner, such as by spraying, dripping, or providing a steady flow of the liquid.

A balancing system 66 may be provided for selectively balancing the drum 16 and ensuring that the laundry load is evenly distributed during a cycle of operation. The balancing system 66 may be a so-called "active balancing system", which detects an imbalance in the drum 16 and takes corrective action to balance the drum 16. Specifically, liquid can be strategically supplied to portions of the balancing system 66 to counterbalance the imbalance in the drum 16. The liquid can be supplied from the liquid supply system 40.

The balancing system 66 may include a first or rear balancing ring 68 provided on a rear end of the drum 16 and a second or front balancing ring 70 provided on a front end of the drum 16. The rear balancing ring 68 includes spaced front and rear side walls 72, 74, and spaced inner and outer walls 76, 78, with the inner and outer walls 76, 78 extending between the front and rear side walls 72, 74. Similarly, the front balancing ring 70 includes spaced front and rear side walls 80, 82, and spaced inner and outer walls 84, 86, with the inner and outer walls 84, 86 extending between the front and rear side walls 80, 82. Alternatively, the balancing system 66 can include a single balancing ring provided on either the front or rear of the drum 16.

The balancing rings 68, 70 may receive liquid from a feeder 88, which may be fluidly coupled to the household water supply 42. The rear balancing ring 68 may be fluidly coupled to the feeder 88 to receive liquid more or less directly from the feeder 88. The front balancing ring 70 may be fluidly coupled to the feeder 88 via at least one of the lifters 26, such that the front balancing ring 70 receives liquid indirectly from the feeder 88 via at least one of the lifters 26. As such, the lifters 26 may be considered part of the balancing system 66. It is also contemplated that the front balancing ring 70 may further receive liquid via the rear balancing ring 68 in addition to at least one of the lifters 26. The rear and front balancing rings 68, 70 may drain liquid into the tub 14. The rear balancing ring 68 may drain liquid more or less directly into the tub 14, while the front balancing ring 70 may drain liquid indirectly into the tub 14 via at least one of the lifters 26. From the tub 14, the liquid drained from the balancing system 66 can be drained from the washing machine 10 via the liquid drain system 54, or may be recirculated into the treating chamber 18 by the liquid recirculation system 60.

The feeder 88 may be provided on a rear end of the drum 16 and may be an annulus with a rear face 90, a front face 92, and an outer peripheral face 94 joining the rear and front faces 90, 92. The feeder 88 may include multiple channels 96 for supplying liquid to the balancing rings 68, 70 and a central opening 98 allowing the drive shaft 22 of the motor 20 to pass through the feeder 88 and couple to the drum 16. Alternatively, the feeder 88 may be attached to the drive shaft 22 or mounted in some other manner such that the feeder 88 rotates with the drum 16.

Each channel 96 may further include a dedicated spray nozzle 100 which supplies the channel 96 with liquid. The spray nozzles 100 may be fluidly coupled to the household water supply 42 by operation of one or more valves 102 controlling the flow of liquid through one or more conduits 104. As illustrated, a valve 102 is provided for each channel 96, such that liquid can be selectively directed to different portions of the balancing rings 68, 70 as needed to correct an imbalance in the drum 16.

The balancing system 66 may further include means for detecting an imbalance in the drum 16. The detecting means may further detect the location and/or magnitude of the imbalance. The specifics of the detecting means are not germane to the invention, and will not be described in detail herein. There are many known imbalance detection methods that are based on output from a motor controller, load cell, or accelerometer. Often, such methods process the torque signal from the motor. Some examples of suitable methods for determining imbalance conditions in a clothes washing machine are given in U.S. Pat. No. 7,296,445 to Zhang et al. and U.S. Pat. No. 7,739,764 to Zhang et al. In other detection methods, at least one sensor 106 for detecting an imbalance within the washing machine 10 during a cycle of operation may be provided. The sensor 106 may be positioned on the tub 14.

A controller 108 may be located within the cabinet 12 for controlling the operation of the washing machine 10 to implement one or more cycles of operation, which may be stored in a memory of the controller 108. Examples, without limitation, of cycles of operation include: wash, heavy duty wash, delicate wash, quick wash, refresh, rinse only, and timed wash. A user interface 110 that is operable coupled to the controller 108 may also be included on the cabinet 12 and may include one or more knobs, switches, displays, and the like for communicating with the user, such as to receive input and provide output.

During operation of the washing machine 10, the controller 108 may be operably coupled with one or more components of the washing machine 10 for communicating with and controlling the operation of the component to complete a cycle of operation. For example, the controller 108 may be operably coupled with at least the motor 20, the valves 44, 48, 102 the drain pump 56, the recirculation pump 62, and the sensor 106 to control the operation of these and other components to implement one or more of the cycles of operation.

Figure 2:
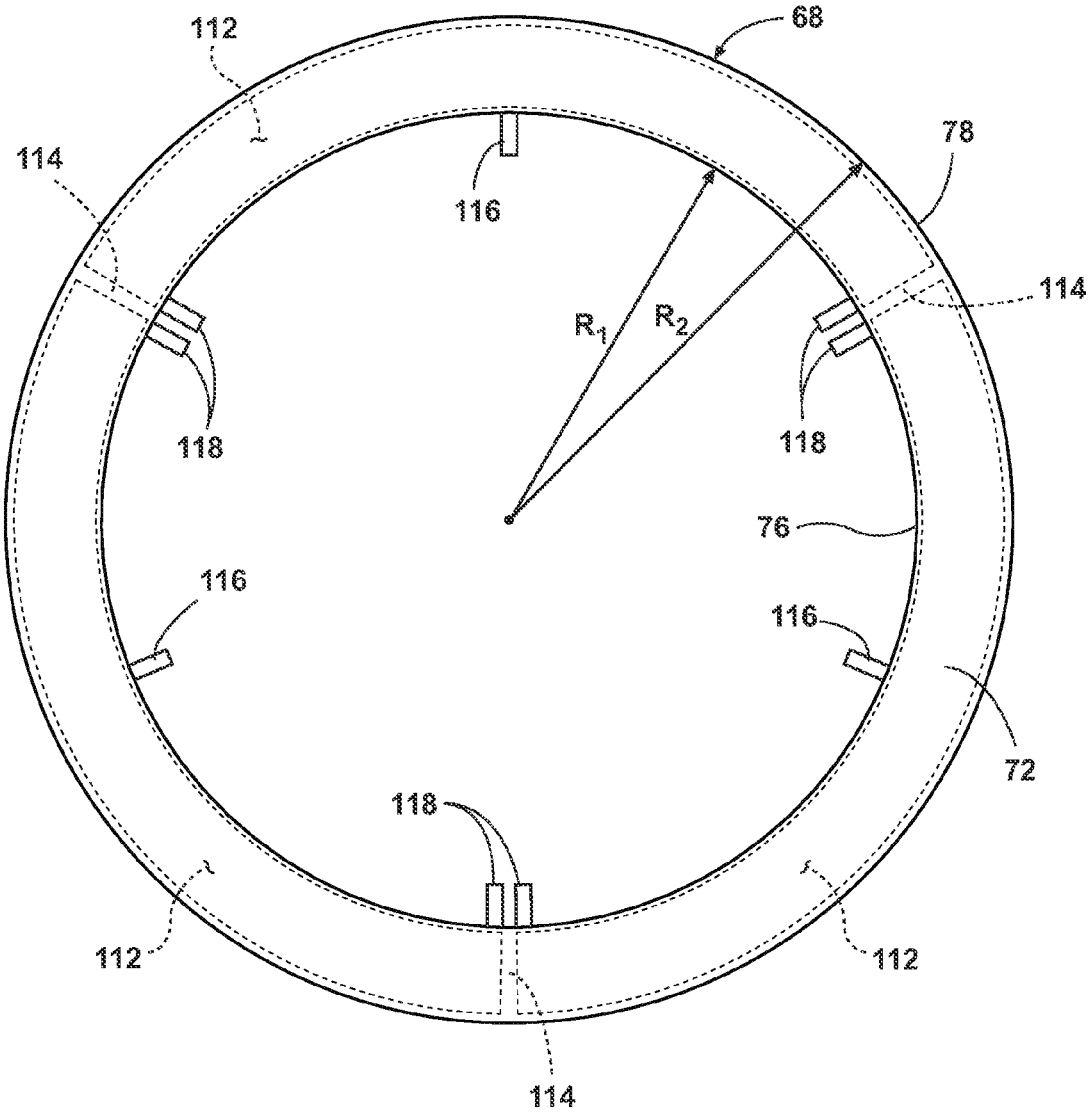
FIG. 2 is a front view of a rear balancing ring for the balancing system of FIG. 1.

FIG. 2 is a front view of the rear balancing ring 68. The inner and outer walls 76, 78 of the rear balancing ring 68 are circular in shape, and respectively define an inner radius R1 and an outer radius R2 of the rear balancing ring 68. The rear balancing ring 68 may further include at least one fluid chamber 112 into which liquid may be introduced. As illustrated, multiple chambers 112 can be provided; more specifically, three fluid chambers 112 are provided. The chambers 112 are separated by internal dividing walls 114 (shown in phantom line) extending between the inner and outer walls 76, 78.

Each chamber 112 includes an inlet in fluid communication with the feeder 88 (FIG. 1). The inlets in the illustrated embodiment are formed by inlet conduits 116 that extend from the inner wall 76 toward the center of the inner radius R1. The inlet conduits 116 may be evenly spaced about the inner wall 76, with approximately 120° between adjacent inlet conduits 116.

Each chamber 112 further includes at least one outlet in fluid communication with the tub 14. In the illustrated embodiment, each chamber 112 is provided with two outlets formed by outlet conduits 118 that extend from the inner wall 76 toward the center of the inner radius R1. The outlet conduits 118 for each chamber 112 may be positioned near opposite ends of the chamber 112, such as adjacent to the dividing walls 114 separating one chamber 112 from the adjacent chambers 112. The length of the outlet conduits 118 may be determined based on an anticipated water level in the tub 14 during a cycle of operation, such that the opening into each outlet conduits 118 is above the anticipated water level.

Figure 3:
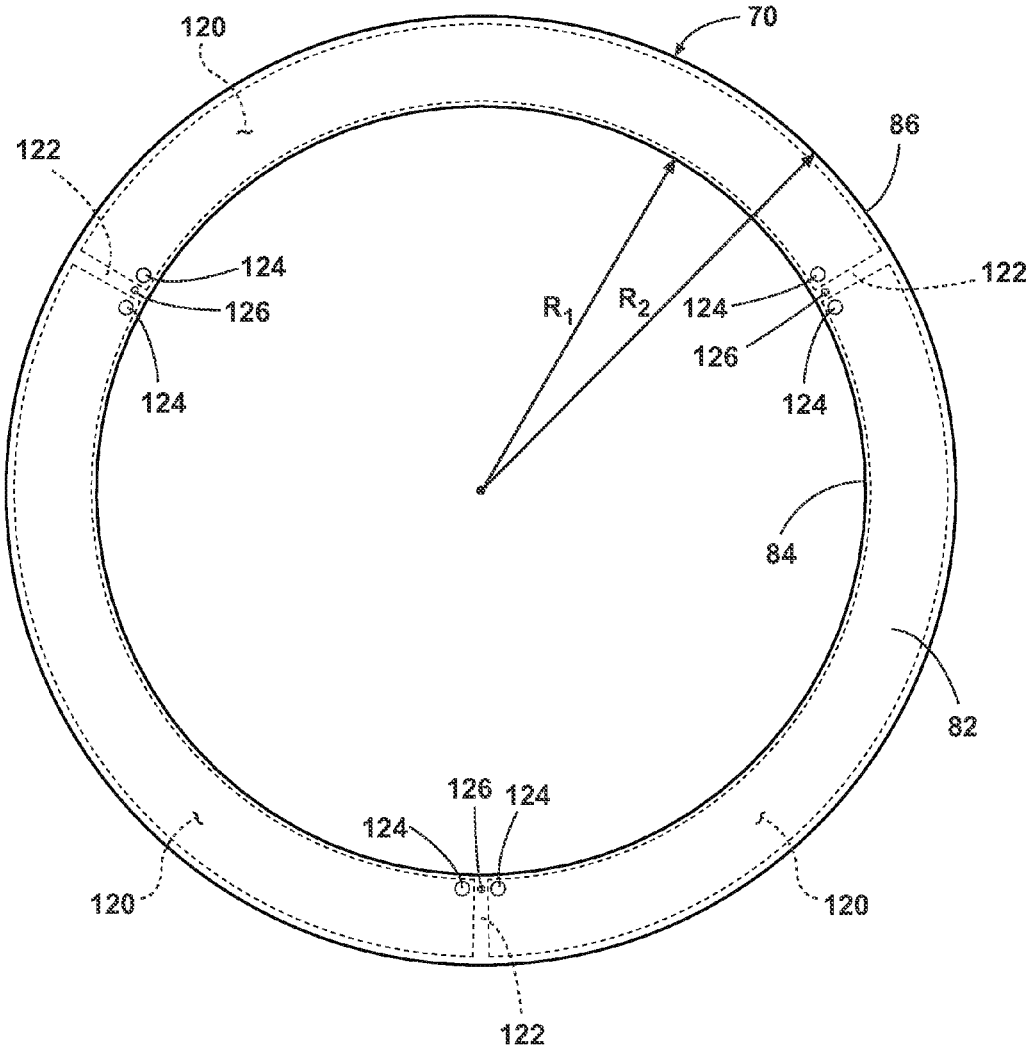
FIG. 3 is a rear view of a front balancing ring for the balancing system of FIG. 1.

FIG. 3 is a rear view of the front balancing ring 70. The inner and outer walls 84, 86 of the front balancing ring 70 are circular in shape, and respectively define an inner radius R1 and an outer radius R2 of the front balancing ring 70. The front balancing ring 70 may further include at least one fluid chamber 120 into which liquid may be introduced. As illustrated, multiple chambers 120 can be provided; more specifically, three chambers 120 are provided. The chambers 120 are separated by internal dividing walls 122 (shown in phantom line) extending between the inner and outer walls 84, 86.

Each chamber 120 includes at least one outlet in fluid communication with one of the lifters 26 (FIG. 1). In the illustrated embodiment, each chamber 120 is provided with two outlets formed by outlet ports 124 in the rear side wall 82. The outlet ports 124 for each chamber 120 may be positioned near opposite ends of the chamber 120, such as adjacent to the dividing walls 122 separating one chamber 120 from the adjacent chambers 120.

Each chamber 120 further includes an inlet in fluid communication with one of the lifters 26 (FIG. 1). The inlets in the illustrated embodiment are formed by passages 126 extending from the rear side wall 82 into one of the chambers 120. The passages 126 may be evenly spaced about the rear side wall 82, with approximately 120° between adjacent passages 126.

Figure 4:
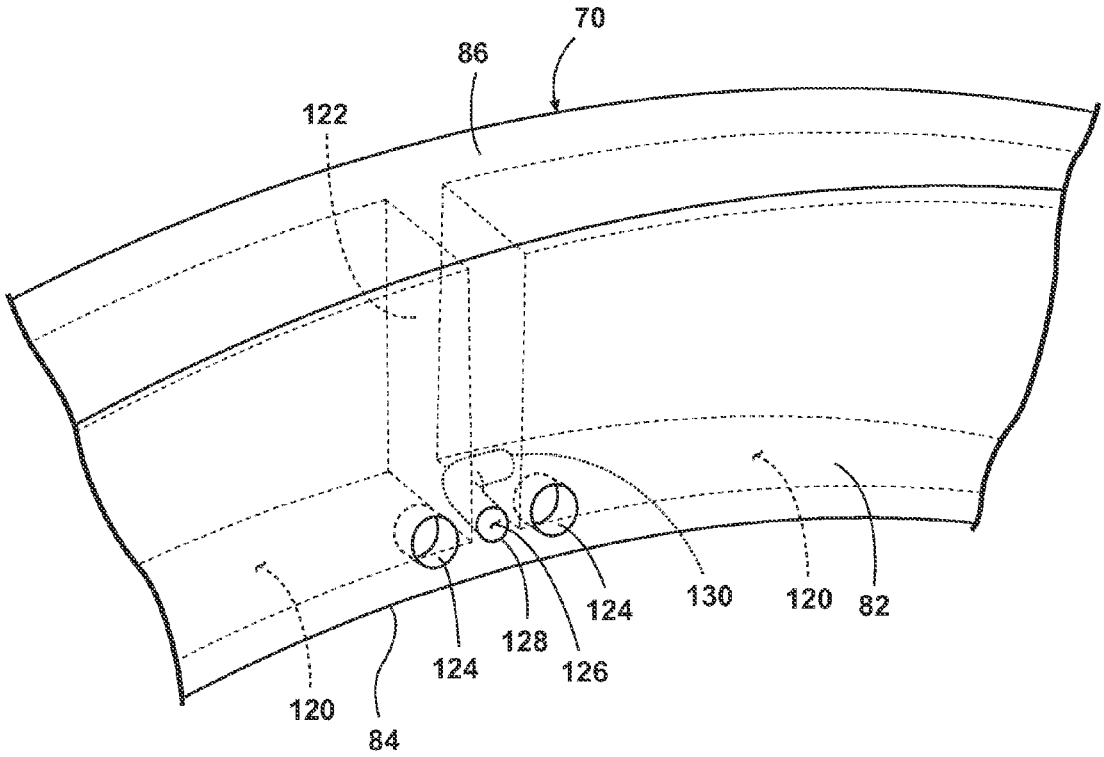
FIG. 4 is close-up view of a portion of the front balancing ring from FIG. 3, with a portion removed to illustrate features of the front balancing ring more clearly.

FIG. 4 is close-up view of a portion of the front balancing ring from FIG. 3. The passages 126 may extend through a gap formed between adjacent chambers 120. More specifically, the passages 126 may extend through the dividing wall 122 between adjacent chambers 120. Each passage 126 may be angled or curved such that an entrance 128 and exit 130 of the passage 126 are not parallel to each other. For example, in the illustrated embodiment, the entrance 128 to the passage 126 is formed in the rear side wall 82, while the exit 130 from the passage 126 is formed in the dividing wall 122 leading to one of the chambers 120. As such, there is an approximately 90° turn in the passage 126.

As illustrated in FIGS. 2 and 3, the outlet conduits 118 for the rear balancing ring 68 and the outlet ports 124 for the rear balancing ring 70 may be positioned closer to the inner radius R1 of the respective balancing ring than the outer radius R2. When the drum 16 rotates, liquid in the balancing rings 68, 70 is forced toward the outer walls 78, 86 by centrifugal force, which spaces the liquid from the outlet conduit 118 or outlet port 124, and prevents it from exiting the respective chamber 112, 120. When the drum 16 stops rotating, liquid naturally flows back to the lowest point in the chamber 112, 120 by gravity; for chambers 112, 120 oriented at or near a 12 o'clock position of the drum 16, the lowest point is near at least one of the dividing walls 114, 122, allowing liquid to flow out of the chamber 112, 120 through the outlet conduit 118 or outlet port 124. Liquid may also drain from the chambers 112, 120 when rotating the drum 116 at a relatively low rotational speed, which is a function of the radius of the drum 16. For example, a radius of approximately 21.6 inches for the drum 16 and a rotational speed of less than or equal to 25 RPM will provide insufficient centrifugal force to overcome the gravitational force acting on the liquid and the liquid will drain out of the balancing rings 68, 70.

Figure 5:
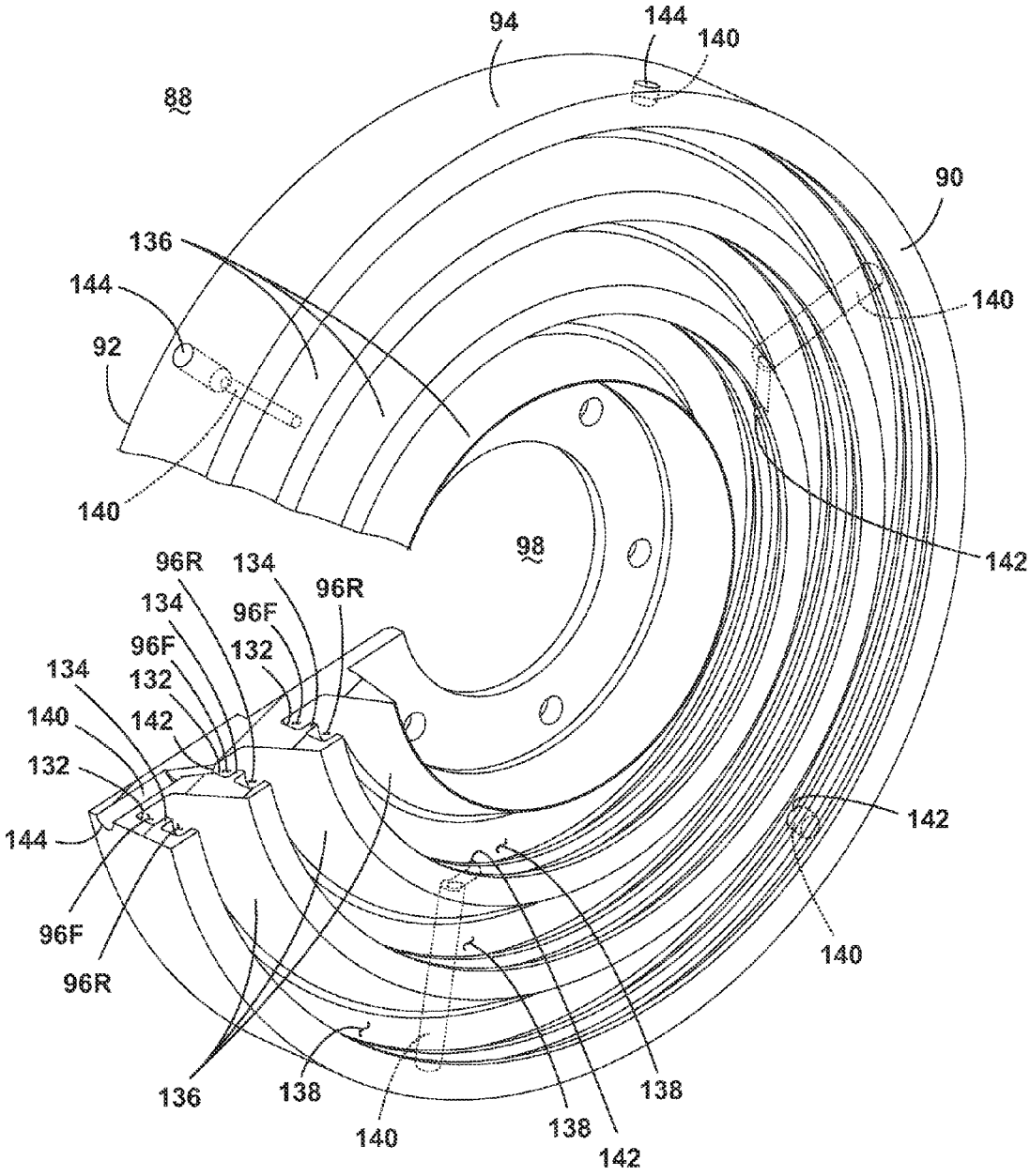
FIG. 5 is a rear perspective view of a feeder for the balancing system of FIG. 1, partially cut away to illustrate features of the feeder more clearly.

FIG. 5 is a rear perspective view of the feeder 88, partially cut away to illustrate features of the feeder 88 more clearly. The number of channels 96 may be dictated by the number of chambers 112, 120 provided in the balancing rings 68, 70 (FIG. 1), with at least one channel 96 provided per chamber 112, 120. In the illustrated embodiment, since six total chambers 112, 120 are provided in the balancing rings 68, 70, six channels 96 are provided in the feeder 88.

The channels 96 may be formed in a stacked relationship, with each pair of channels 96 defining a rear channel and a front channel, which may be designated at 96R and 96F, respectively, for purposes of discussion. The channels 96 may further be formed in a concentric relationship, with a first pair of stacked channels 96 formed at an inner radial position adjacent to the central opening 98, a second pair of stacked channels 96 formed radially outwardly from the first pair and a third pair of stacked channels 96 formed radially outwardly from the second pair. Other arrangements of channels 96 besides the stacked-and-concentric arrangement shown herein are possible. For example, the channels 96 may be concentric but not stacked. In another example, the channels 96 may be stacked but not concentric. In yet another example, the channels 96 may be provided on one or both of the rear and front faces 90, 92 of the feeder 88.

Each pair of channels 96 is defined by an outer wall 132 having a partition 134 that separates the rear channel 96R from the front channel 96F and inner wall 136. The inner wall 136 may be angled, which may help deflect liquid being drained out of the channels 96 to prevent the liquid from reentering the channels 96.

Each pair of channels 96 further includes an inlet opening 138 formed in the rear face 90 of the feeder 88. The spray nozzles 100 (FIG. 1) may extend into the inlet openings 138 from the rear of the feeder 88, and may be directed toward the outer wall 132 of each channel 96. The inlet openings 138 may extend around the central opening 98 in concentric circles, which allows the spray nozzles 100 to remain stationary while supplying liquid to the rotating feeder 88.

Each channel 96 further includes an outlet in fluid communication with the rear balancing ring 68 or with one of the lifters 26 (FIG. 1). The outlets may be defined by outlet conduits 140 extending from each of the channels 96 to the outer peripheral face 94 of the feeder 88. An entrance 142 to the outlet conduits 140 may be formed in the outer wall 132 of each channel 96 and an exit 144 from the outlet conduits 140 may be formed in the outer peripheral face 94. The outlet conduits 140 may be evenly spaced about the circumference of the feeder 88, although the length of the outlet conduits 140 may vary depending on the radial position of the channel 96 relative to the outer peripheral face 140. When the feeder 88 rotates, liquid entering the channels 96 is forced toward the outer walls 132 by centrifugal force and flows out of the channels 96 through the outlet conduits 140 to either the rear balancing ring 68 or the lifters 26. Each channel 96 supplies a different chamber 112, 120 in the balancing rings 68, 70.

Figure 6:
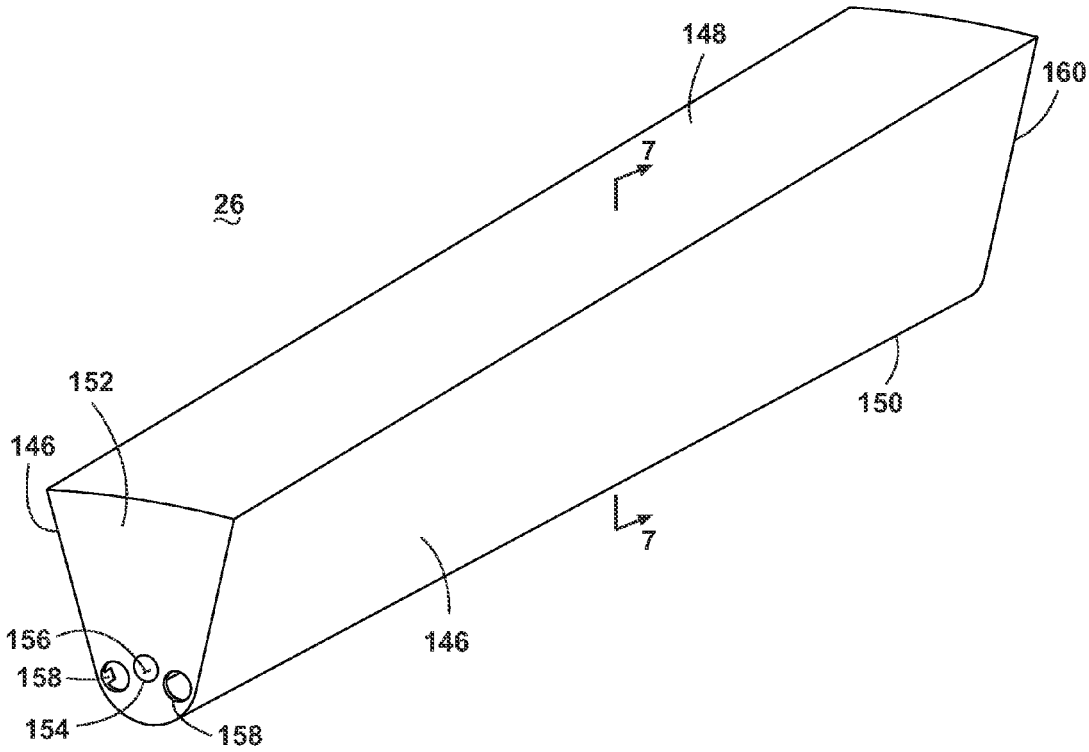
FIG. 6 is a front perspective view of a lifter of the drum of FIG. 1.

FIG. 6 is a front perspective view of one of the lifters 26. The lifter 26 may be a generally triangular cross-sectional shape, with two side walls 146 that are inclined relative to each other, and which are joined at their outer ends by a base wall 148 and at their inner ends by a curved tip 150. The lifter 26 may further have a front end wall 152 which is joined to the front ends of the side walls 146. The front end wall 152 includes an outlet opening 154 of a supply conduit 156 and two drain inlets 158. The lifter 26 may further have a rear end wall 160 which is joined to the rear ends of the side walls 146.

Figure 7:
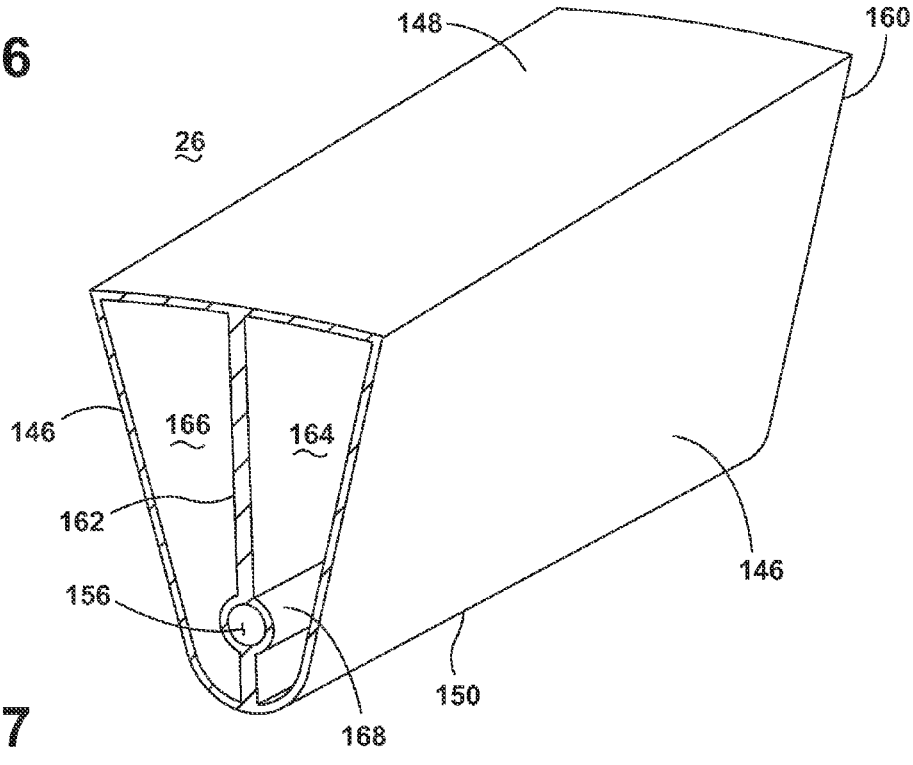
FIG. 7 is a cross-sectional view of the lifter through line 7-7 of FIG. 6.

FIG. 7 is a cross-sectional view of the lifter 26 through line 7-7 of FIG. 6. The lifter 26 may have a substantially hollow interior, with a partition 162 that divides the hollow interior into a first chamber 164 and a second chamber 166. The supply conduit 156 may pass lengthwise through the partition 162, and may include a tube 168 that is formed within the partition 162.

Figure 8A:
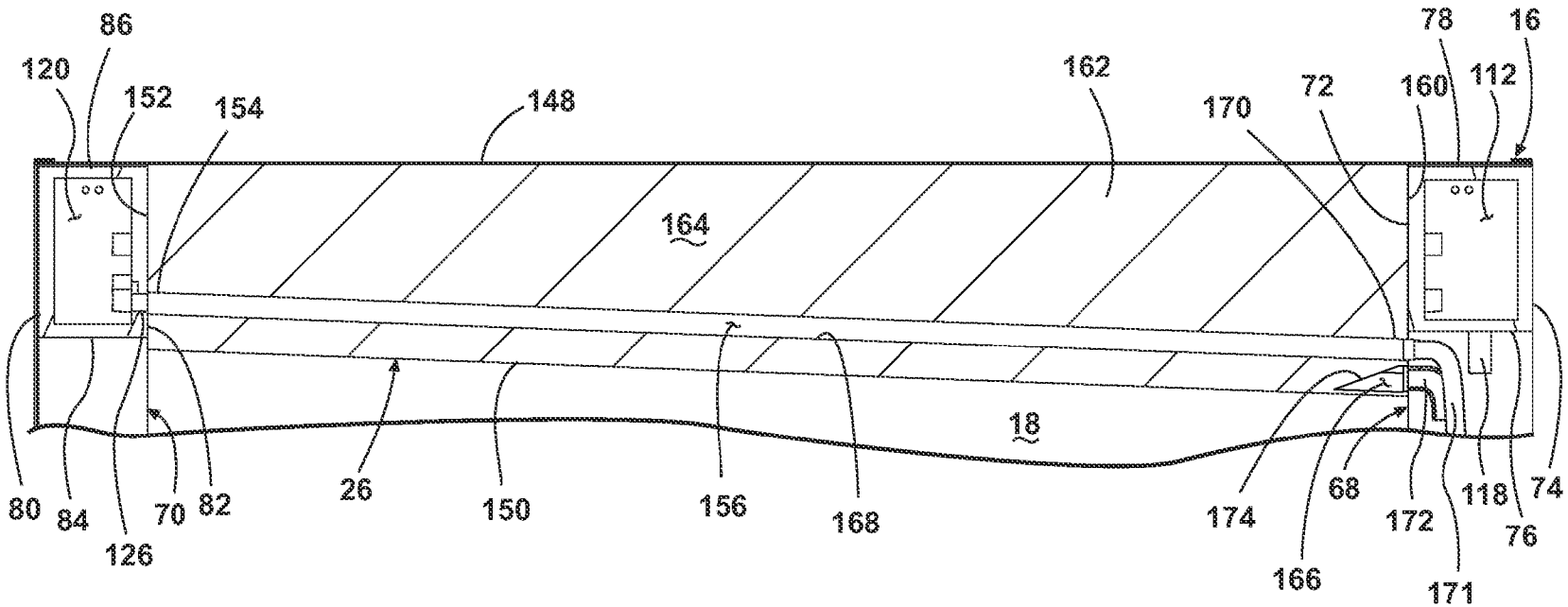
FIG. 8A is a close-up review of a portion of FIG. 1, illustrating a liquid supply path through one of the lifters of the drum of FIG. 1.

FIG. 8A is a close-up review of a portion of FIG. 1, illustrating a liquid supply path through one of the lifters 26. The rear end wall 160 of the lifter 26 further includes an inlet opening 170 of the supply conduit 156, which supplies liquid from the feeder 88 (FIG. 5) to the front balancing ring 70, and an outlet conduit 172, which drains liquid from the lifter 26. The inlet opening 170 can be coupled to one of the outlet conduits 140 of the feeder 88 by a hose 171 or other suitable conduit. The outlet conduit 172 may extend outwardly from the rear end wall 160 and toward the rotational axis X (FIG. 1) of the drum 16. The length of the outlet conduit 172 may be determined based on an anticipated water level in the tub 14 during a cycle of operation, such that the opening into each outlet conduit 172 is above the anticipated water level.

The lifter 26 is mounted to the drum 16 with respect to the front balancing ring 70 such that the lifter 26 spans a portion of two fluid chambers 120. At the rear end of the drum 16, the outlet conduit 172 opens into a spaced in fluid communication with the liquid-holding chamber defined by the tub 14. At the front end of the drum 16, the outlet opening 154 of the supply conduit 156 is aligned with one of the passages 126 in the front balancing ring 70.

The partition 162 may include a continuous wall that extends substantially from the rear end wall 160 to the front end wall 152 and substantially from the base wall 148 to the tip 150 of the lifter 26; however, in the illustrated embodiment, the partition 162 includes an opening 174 which fluidly connects the first chamber 164 to the second chamber 166. The opening 174 may be formed closer to the tip 150 than the base wall 148, such that the opening 174 is closer to the center of the drum 16 than the inner periphery.

The tube 168 forming the supply conduit 156 may be angled, such that one end of the tube 168 is radially closer to the rotational axis X of the drum 16 (FIG. 1) than the other end. When the drum 16 rotates, liquid introduced into the supply conduit 156 is forced outwardly by centrifugal force, which naturally drives the liquid along the angled supply conduit 156 from the inlet opening 170 to the outlet opening 154. As illustrated, the inlet opening 170 may be radially closer to the rotational axis X of the drum 16 than the outlet opening 154 and the radial distance from the rotational axis X to the supply conduit 156 increases along the length of the supply conduit 156 from the inlet opening 170 to the outlet opening 154. The increase in radial distance between the rotational axis X and supply conduit 156 may be relatively constant, such that the radial distance never decreases along the length of the supply conduit 156. As shown, the supply conduit 156 may be generally straight between the outlet and inlet openings 156, 170; alternatively the supply conduit 156 may be formed with sections that are more steeply angled than other sections.

Figure 8B:
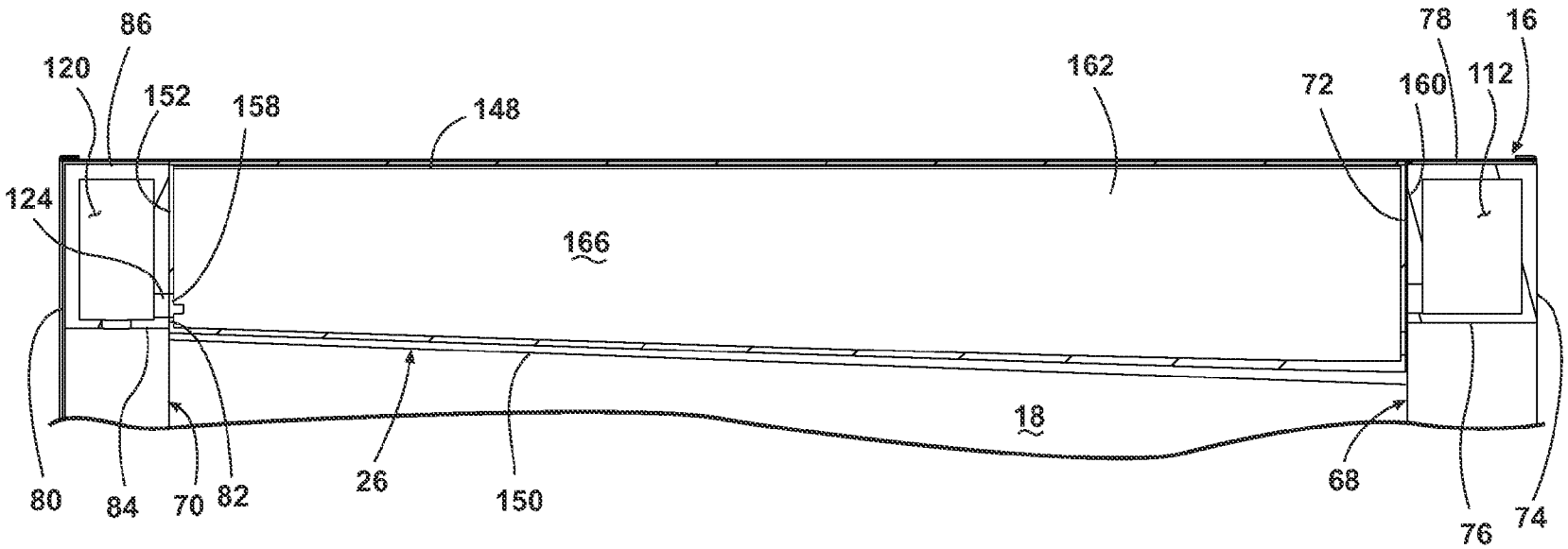
FIG. 8B is a close-up review of a portion of FIG. 1, illustrating a liquid drain path through one of the lifters of the drum of FIG. 1.

FIG. 8B is a close-up review of a portion of FIG. 1, illustrating a liquid drain path through one of the lifters 26. At the front end of the drum 16, the first and second chambers 164, 166 (only chamber 166 is visible in FIG. 8B) in the lifter 26 are each aligned with one of the drain ports 124 in the front balancing ring 70. Each of the first and second chambers 164, 166 may define at least a portion of a drain conduit that fluidly couples one of the chambers 120 in the front balancing ring 70 to the tub 14, with the drain inlets 158 in the front end wall 152 of the lifter 26 forming an inlet into the drain conduits and the outlet conduit 172 forming an outlet from the drain conduits. The outlet conduit 172 may extend through the drum 16 such that the liquid is drained into the liquid-holding chamber defined by the tub 14. Each chamber 164, 166 in the lifter 26 drains a different fluid chamber 120.

The drain conduit may extend generally along an interior surface of the lifter 26 that may be defined by the tip 150. The tip 150 of the lifter 26 may be sloped to create an angled drain conduit, such that one end of the lifter 26 is radially closer to the rotational axis X of the drum 16 (FIG. 1) than the other end. As illustrated, the end of the lifter 26 near the rear end wall 160 may be radially closer to the rotational axis X of the drum 16 than the end of the lifter 26 near the front end wall 152. When the drum 16 stops rotating, liquid entering the lifter 26 from the front balancing ring 70 naturally flows to the lowest point in the lifter 26 by gravity; for a lifter 26 oriented at or near a 12 o'clock position of the drum 16, the lowest point is near the rear end wall 160, allowing liquid to flow out of the lifter 26 through the outlet conduit 172. Liquid may also drain from the lifters 26 when rotating the drum 16 at a relatively low rotational speed that is a function of the radius of the drum 16, such as less than or equal to 25 RPM for a drum with a radius of approximately 21.6 inches, such that gravity acting on the liquid overcomes the centrifugal force generated by the rotating drum 16.

In operation, with reference to FIG. 1, when an imbalance in the drum 16 is detected by the sensor 106, the controller 108 determines what corrective action is needed to counterbalance the imbalance in the drum 16. This determination may include identifying one of the fluid chambers 112, 120 to receive liquid to at least partially offset an imbalance in the rotating drum 16. Liquid from the household water supply 42 is directed to liquid channels 96 of the feeder 88 associated with the identified fluid chambers 112, 120 by opening the associated valves 102. This is done while the drum 16 and feeder 88 are rotating together, such that liquid is distributed along the liquid channel 96 of the feeder 88 by centrifugal force.

If liquid is to be directed to one of the fluid chambers 112 in the rear balancing ring 68, liquid from the feeder 88 is supplied via the associated outlet conduit 140 to the inlet conduit 116 of the fluid chamber 112. As shown in FIG. 1, the outlet conduits 140 can be coupled to the inlet conduit 116 by a hose 176 or other suitable conduit. Liquid is supplied while the drum 16, feeder 88, and rear balancing ring 68 are rotating together, such that the liquid is forced outwardly from the feeder 88 and through the inlet conduit by centrifugal force. Furthermore, liquid entering the fluid chamber 112 will be forced against the outer wall 78 of the rear balancing ring 68, away from the outlet conduits 118.

If liquid is to be directed to one of the fluid chambers 120 in the front balancing ring 68, liquid from the feeder 88 is supplied via the associated outlet conduit 140 and hose 171 to the supply conduit 156 of the associated lifter 26. The liquid passes through the supply conduit 156 and into the fluid chamber 120. This is also done while the drum 16, feeder 88, lifter 26, and front balancing ring 70 are rotating together, such that the liquid is forced outwardly from the feeder 88 and through the supply conduit 156 by centrifugal force. Furthermore, liquid entering the fluid chamber 120 will be forced against the outer wall 86 of the front balancing ring 70, away from the outlet ports 124.

The liquid may be drained from the balancing rings 68, 70 any time; it is no longer necessary to have the counterbalance, such as at the conclusion of a spin phase of a cycle of operation. To drain liquid from one of the fluid chambers 112 in the rear balancing ring 68, the drum 16 may be rotated until the fluid chamber 112 is at or near a 12 o'clock position of the drum 16, allowing liquid to flow out of the fluid chamber 112 through the outlet conduits 118 and into the tub 14. Alternatively, the liquid may be drained while the drum 16 rotates at a relatively low speed that is a function of the radius of the drum 16, such as less than or equal to 25 RPM for a drum with a radius of approximately 21.6 inches, such that the gravitational force acting on the liquid overcomes the centrifugal force generated by the rotating drum 16, allowing the liquid to drain out through the outlet conduits 118 as the drum 16 continues to rotate. From the tub 14, the liquid may be drained via the liquid drain system 54.

To drain liquid from one of the fluid chambers 120 in the front balancing ring 70, the drum 16 may be rotated until the fluid chamber 120 is at or near a 12 o'clock position of the drum 16, allowing liquid to flow out of the fluid chamber 120 through the outlet ports 124 and into the drain conduits defined by the chambers 164, 166 in the lifter 26, shown in FIG. 8B. Since the outlet ports 124 of a single fluid chamber 120 are coupled to two different lifters 26, liquid from one fluid chamber 120 may be drained via two different lifters 26. The liquid passes through the lifter 26 and into the tub 14 via the outlet conduit 172. Alternatively, the liquid may be drained while the drum 16 rotates at a relatively low speed that is a function of the radius of the drum 16, such as less than or equal to 25 RPM for a drum with a radius of approximately 21.6 inches, such that the gravitational force acting on the liquid overcomes the centrifugal force generated by the rotating drum 16, allowing the liquid to drain out through the lifters 26 as the drum 16 continues to rotate. From the tub 14, the liquid may be drained via the liquid drain system 54.

Figure 9:
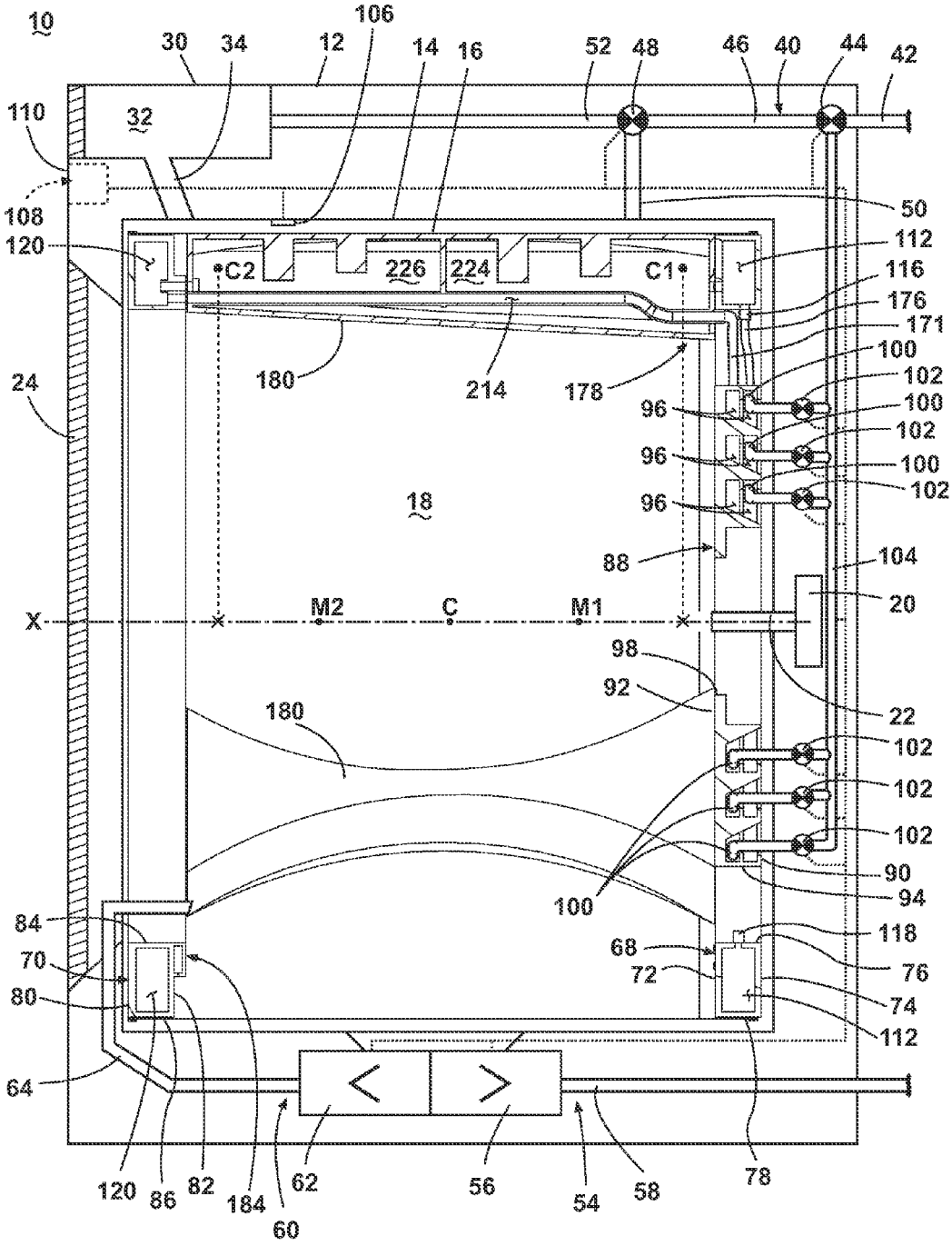
FIG. 9 is a schematic view of a laundry treating appliance according to a second embodiment of the invention, illustrating a drum with a balancing system.

FIG. 9 is a schematic view of a laundry treating appliance according to a second embodiment of the invention. Like the first embodiment, the second embodiment of the laundry treating appliance is in the form of a clothes washing machine 10, and like elements of the second embodiment will be referred to with the same reference numerals used in the second embodiment. The second embodiment of the clothes washing machine 10 is provided with a modified balancing system 178. The balancing system 178 may include the same basic components, including the first or rear balancing ring 68, the second or front balancing ring 70, the feeder 88, and the sensor 106. The feeder 88 and sensor 106 may be substantially identical to those described for the first embodiment. The balancing system 178 is further provided with multiple lifters 180 that, like the balancing rings 68, 70 may selectively be supplied with liquid to counterbalance an imbalance in the drum 16

Figure 10:
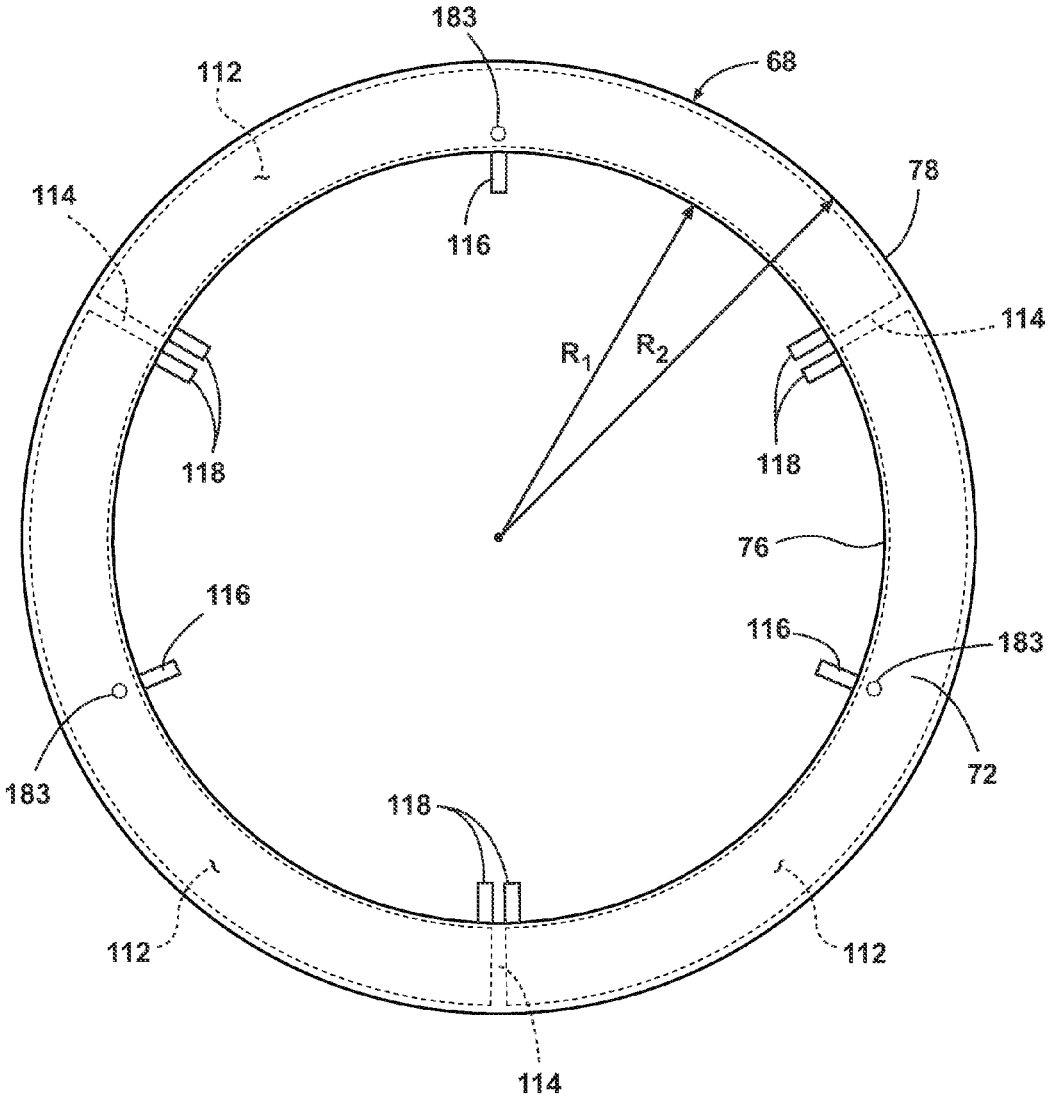
FIG. 10 is a front view of a rear balancing ring for the balancing system of FIG. 9.

FIG. 10 is a front view of the rear balancing ring 68. The rear balancing ring 68 may be substantially identical to that of the first embodiment, with the exception that each fluid chamber 112 includes at least a portion of a supply conduit in fluid communication with one of the lifters 180 (FIG. 9), by which a portion of the liquid from the fluid chamber 112 can be supplied to the lifter 180 for counterbalancing purposes. The supply conduits in the illustrated embodiment are formed supply ports 183 in the front side wall 72. The supply ports 183 may be evenly spaced about the front side wall 72, with approximately 120° between adjacent supply ports 183.

Figure 11:
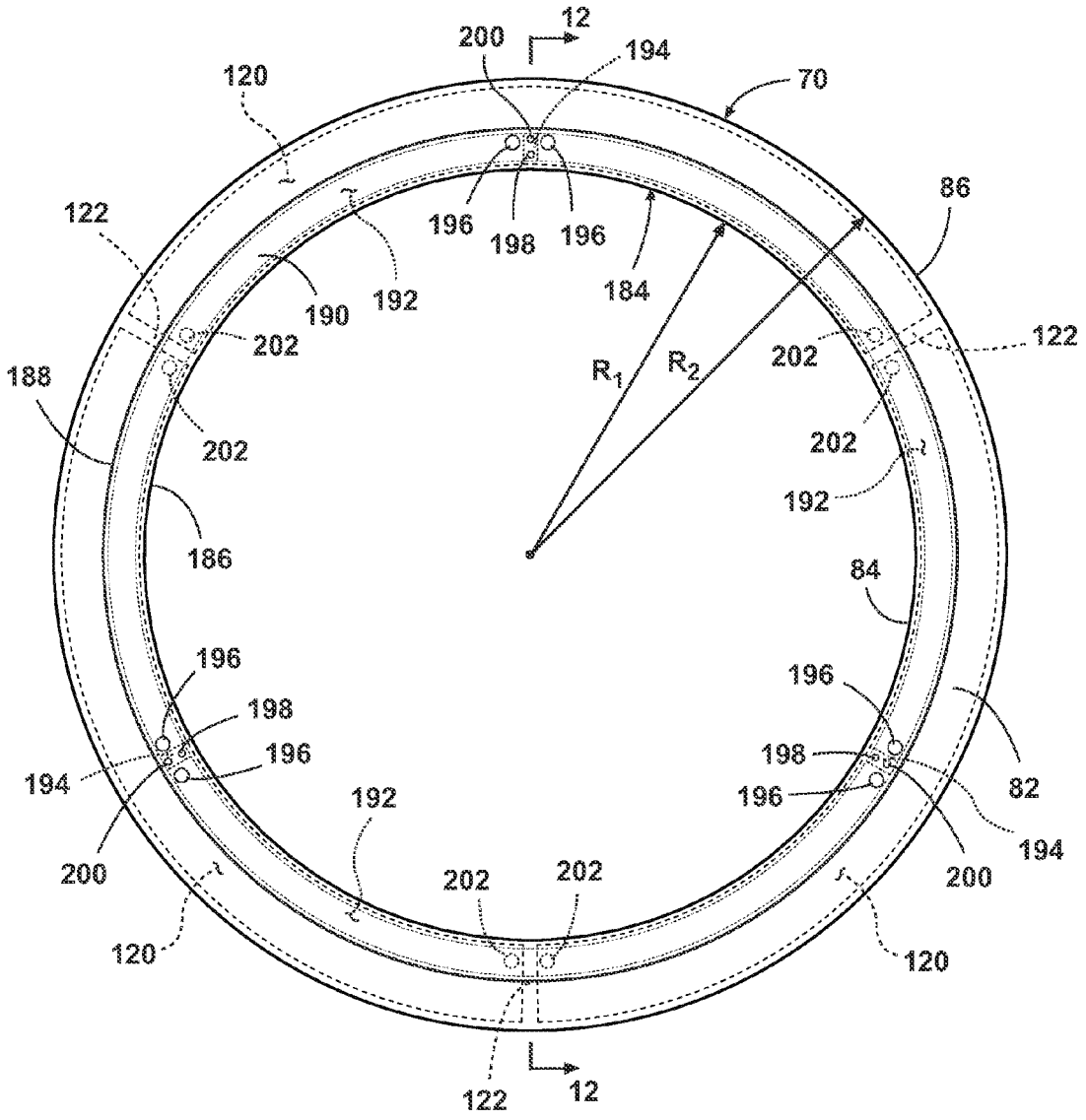
FIG. 11 is a rear view of a front balancing ring for the balancing system of FIG. 9.

FIG. 11 is a rear view of the front balancing ring 70. The front balancing ring 70 may be substantially identical to that of the first embodiment, with the exception of the inlets and outlets in fluid communication with one of the lifters 180 (FIG. 9) and the inclusion of a transfer ring 184. The transfer ring 184 may be provided on the rear side wall 82 and facilitates the transfer of liquid from the chambers 120 to the lifters 26 for draining purposes. The transfer ring 184 includes spaced inner and outer walls 186, 188 and a rear side wall 190 that extends between the inner and outer walls 186, 188. A front side wall of the transfer ring 184 may be defined by the rear side wall 82 of the front balancing ring 70. The inner and outer walls 186, 188 of the transfer ring 184 may be circular in shape. While the transfer ring 184 is shown as projecting rearwardly from the rear side wall 82, the transfer ring 184 may also be provided within the front balancing ring 70 such that the volume of space taken up by the front balancing ring 70 remains the same.

The transfer ring 184 may further include at least one transfer conduit 192 into which liquid may be introduced. As illustrated, multiple chambers 192 can be provided; more specifically, three chambers 192 are provided. The chambers 192 are separated by internal dividing walls 194 (shown in phantom line) extending between the inner and outer walls 186, 188. The transfer conduits 192 may be offset from the fluid chambers 120 in the front balancing ring 70, such that one transfer conduit 192 overlies at least two different fluid chambers 120, and vice versa. As shown, the transfer conduits 192 may be offset approximately 60° from the fluid chambers 120.

Each transfer conduit 192 includes at least one outlet in fluid communication with one of the lifters 180 (FIG. 9). In the illustrated embodiment, each transfer conduit 192 is provided with two outlets formed by outlet ports 196 in the rear side wall 190. The outlet ports 196 for each transfer conduits 192 may be positioned near opposite ends of the transfer conduit 192, such as adjacent to the dividing walls 194 separating one transfer conduit 192 from the adjacent transfer conduits 192.

Each fluid chamber 120 further includes an inlet in fluid communication with one of the lifters 180 (FIG. 9). The inlets in the illustrated embodiment are formed by inlet passages 198 extending through the transfer ring 184 and the rear side wall 82 and into one of the fluid chambers 120. The inlet passages 198 may be evenly spaced about the rear side wall 82, with approximately 120° between adjacent inlet passages 198.

Each fluid chamber 120 includes at least a portion of a supply conduit in fluid communication with one of the lifters 180 (FIG. 9), by which a portion of the liquid from the fluid chamber 120 can be supplied to the lifter 180 for counterbalancing purposes. The supply conduits in the illustrated embodiment are formed by supply passages 200 extending through the rear side wall 82 and the transfer ring 184 into one of the lifters 180. The supply passages 200 may be evenly spaced about the rear side wall 82, with approximately 120° between adjacent outlet passages 200. The supply passages 200 may further be aligned in a radial direction with the inlet passages 198, but may be farther from the inner radius R1 of the front balancing ring 70 than the inlet passages 198.

Figure 12:
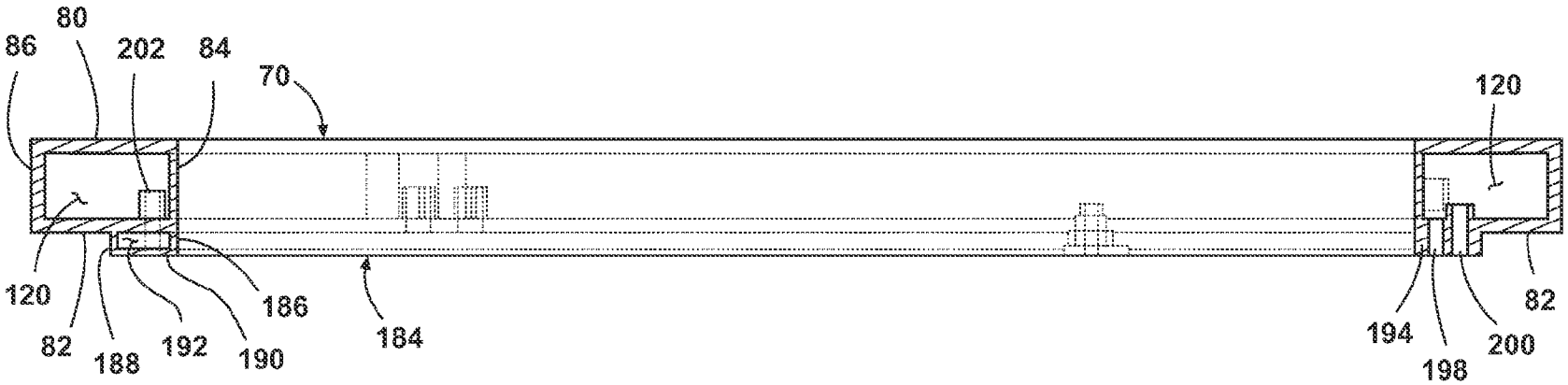
FIG. 12 is a cross-sectional view of the front balancing ring through line 12-12 of FIG. 11.

FIG. 12 is a cross-sectional view of the front balancing ring 70 through line 12-12 of FIG. 11. The inlet and outlet passages 198, 200 may extend through a gap formed between adjacent transfer conduits 192. More specifically, the passages 198, 200 may extend through the dividing wall 194 between adjacent chambers 192. Each fluid chamber 120 further includes an outlet in fluid communication with at least one of the transfer conduits 192. In the illustrated embodiment, each fluid chamber 120 is provided with two outlets formed by drain conduits 202 extending through the rear side wall 82 of the front balancing ring 70. For each one of the fluid chambers 120, each drain conduits 202 is in communication with a different transfer conduit 192. As such, a single transfer conduit 192 may receive liquid from two fluid chambers 120. The drain conduits 202 for each fluid chamber 120 may be positioned near opposite ends of the fluid chamber 120, such as adjacent to the dividing walls 122 in the front balancing ring 70. The drain conduits 202 further extend in a forward direction from the rear side wall 82.

As illustrated in FIGS. 10 and 11, the various outlets for the rear and front balancing rings 68, 70 and the transfer ring 180 may be positioned closer to the inner radius R1 of the respective balancing ring than the outer radius R2. When the drum 16 rotates, liquid in the balancing rings 68, 70 is forced toward the outer walls 78, 86 by centrifugal force, which spaces the liquid from the outlet conduits 118 and drain conduits 202 respectively, and prevents it from exiting the chambers 112, 120. When the drum 16 stops rotating, liquid naturally flows back to the lowest point in the chambers 112, 120 by gravity; for chambers 112, 120 oriented at or near a 12 o'clock position of the drum 16, the lowest point is near at least one of the dividing walls 114, 122, allowing liquid to flow out of the chamber 112, 120 through the conduits 118, 202. Liquid may also drain from the chambers 112, 120 when rotating the drum 116 at a relatively low rotational speed that is a function of the radius of the drum 16, such as less than or equal to 25 RPM for a drum with a radius of approximately 21.6 inches, such that the gravitational force acting on the liquid overcomes the centrifugal force generated by the rotating drum 16.

Figure 13:
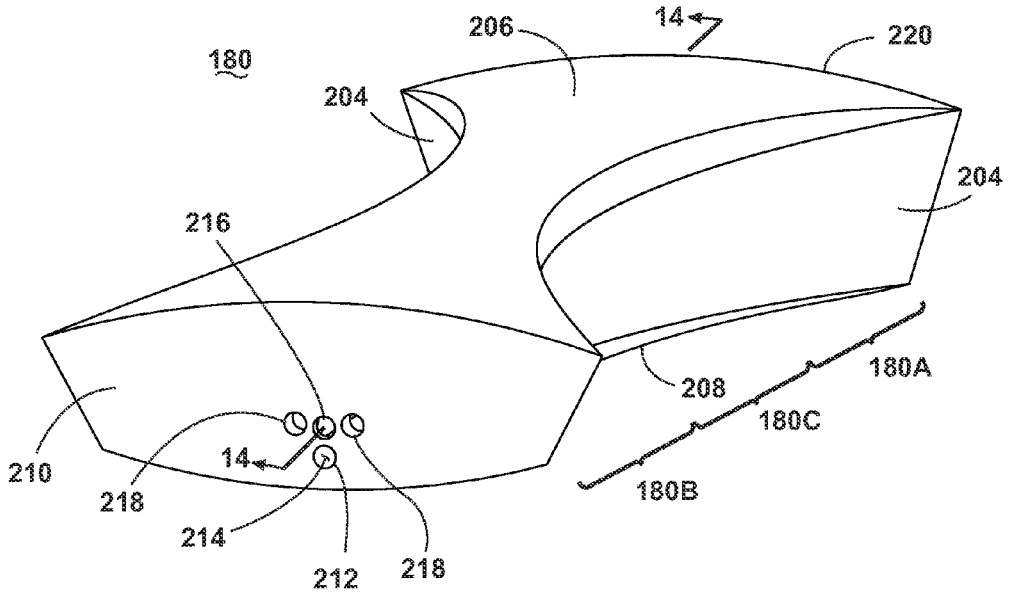
FIG. 13 is a front perspective view of a lifter of the drum of FIG. 9.

FIG. 13 is a front perspective view of one of the lifters 180. The lifter 180 includes two curved side walls 204 which are joined at their outer ends by a base wall 206 and at their inner ends by top wall 208. The lifter 180 may further have a front end wall 210 which is joined to the front ends of the side walls 204. The front end wall 210 includes an outlet opening 212 of a supply conduit 214, an inlet port 216 opening into the lifter 180, and two drain inlets 218. The lifter 180 may further have a rear end wall 220 which is joined to the rear ends of the side walls 204.

The side walls 204 may be generally concave and inclined relative to each other giving the top wall 208 an hourglass shape, and the lifter 180 an overall hourglass-type profile. The lifter 180 may be conceptually divided into opposing first and second end portions 180A, 180B connected by a middle portion 180C. The end portions 180A, 180B generally coincide with the wider wedge-shaped ends of the lifter 180 while the middle portion 180C generally coincides with the narrow middle section of the lifter 180. Due to the hourglass-type profile of the lifter 180, the volume of the middle portion 180C is less than the volume of either of the first or second end portions 180A, 180B.

Figure 14:
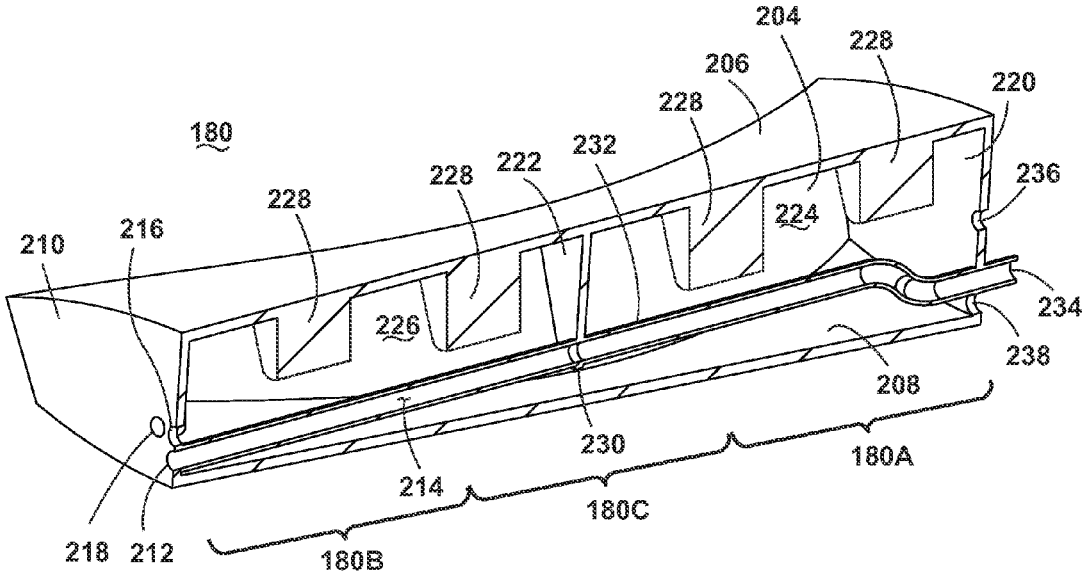
FIG. 14 is a cross-sectional view of the lifter through line 14-14 of FIG. 13.

FIG. 14 is a cross-sectional view of the lifter 180 through line 14-14 of FIG. 13. The lifter 180 may have a substantially hollow interior, with a partition 222 that divides the hollow interior into a first or rear reservoir chamber 224 located within the first wedge-shaped end portion 180A and a second or front reservoir chamber 226 located within the second wedge-shaped end portion 180B. The partition 222 may be positioned at or near the middle portion 180C of the lifter 180. Due to the wedge-shape of the end portion 180A, a greater volume of the rear reservoir chamber 224 is disposed closer to the rear end of the lifter 180 than near the partition 222. Similarly, a greater volume of the front reservoir chamber 226 is disposed closer to the front end of the lifter 180 than near the partition 222. One or more baffles 228 may optionally be provided within the lifter 180 to reduce slosh within the reservoir chambers 224, 226. While not illustrated, baffles may also be provided within the fluid chambers 112, 120 of the balancing rings 68, 70 in any of the embodiments disclosed herein to reduce slosh within the fluid chambers 112, 120.

The partition 222 may include a continuous wall that extends upwardly from the base wall 206 between the side walls 204. A passage 230 is formed between the partition 222 and the top wall 208, which fluidly connects the rear reservoir chamber 224 to the front reservoir chamber 226. The supply conduit 214 may extend through the lifter 180, passing through the partition 222, and may include a tube 232 that is formed between the front and rear end walls 210, 220.

Figure 15A:
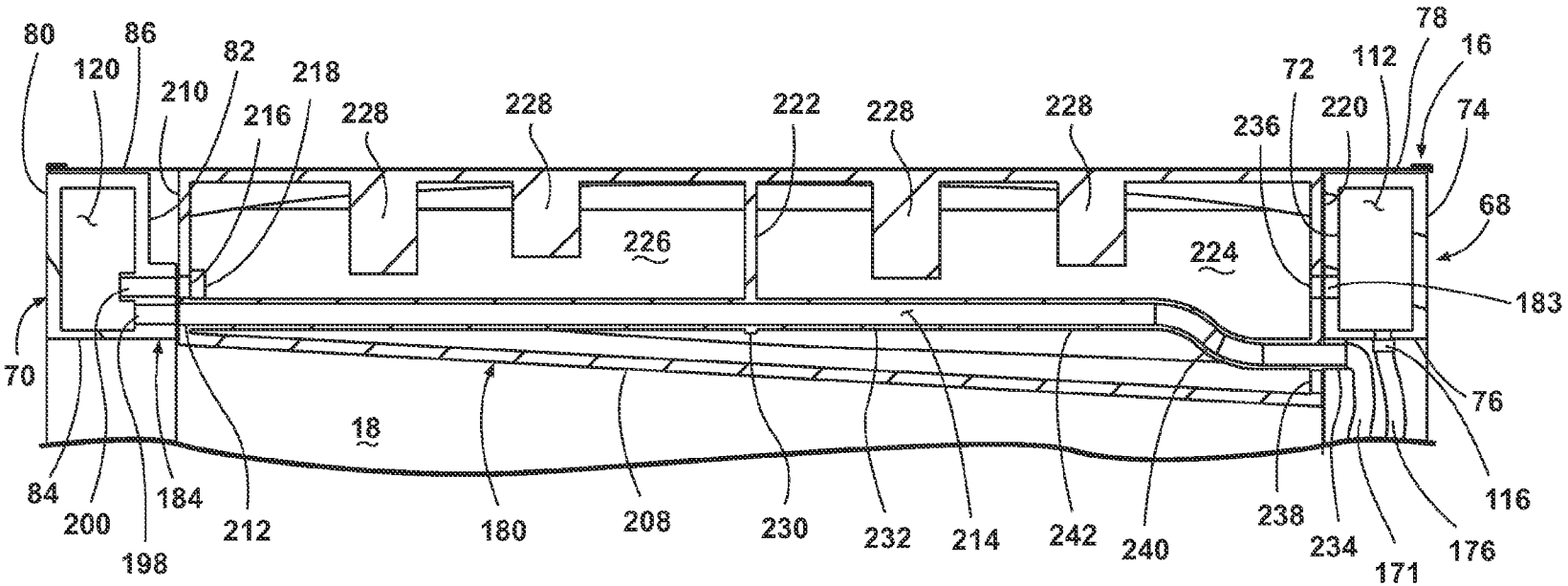
FIG. 15A is a close-up view of a portion of FIG. 9, illustrating a liquid supply path through one of the lifters of the drum of FIG. 9.

FIG. 15A is a close-up review of a portion of FIG. 9, illustrating a liquid supply path through one of the lifters of the drum of FIG. 9. The rear end wall 220 of the lifter 180 further includes an inlet opening 234 of the supply conduit 214, which supplies liquid from the feeder 88 (FIG. 9) to the front balancing ring 70, an inlet port 236 opening into the lifter 180, and a drain outlet 238, which drains liquid from the lifter 180.

At the rear end of the drum 16, the inlet port 236 opening into the rear reservoir chamber 224 of the lifter 180 is aligned with one of the supply ports 183 in the rear balancing ring 68. At the front end of the drum 16, the outlet opening 212 of the supply conduit 214 is aligned with one of the inlet passages 198 in the front balancing ring 70, the inlet port 216 opening into the front reservoir chamber 226 in the lifter 180 is aligned with one of the supply passages 200 in the front balancing ring 70.

Like the first embodiment, the tube 232 forming the supply conduit 214 may be angled, such that one end of the tube 232 is radially closer to the rotational axis X of the drum 16 than the other end. However, instead of being generally straight, the supply conduit 214 may have a first portion 240 and a second portion 242, wherein the first portion 240 is more steeply angled than the second portion 242. As shown, the more steeply angled first portion 240 may be closer to the inlet opening 234 and the less steeply angled second portion 242 may be closer to the outlet opening 212. When the drum 16 rotates, liquid introduced into the supply conduit 214 is forced outwardly by centrifugal force, which naturally drives the liquid along the angled supply conduit 214 from the inlet opening 234 to the outlet opening 212.

Figure 15B:
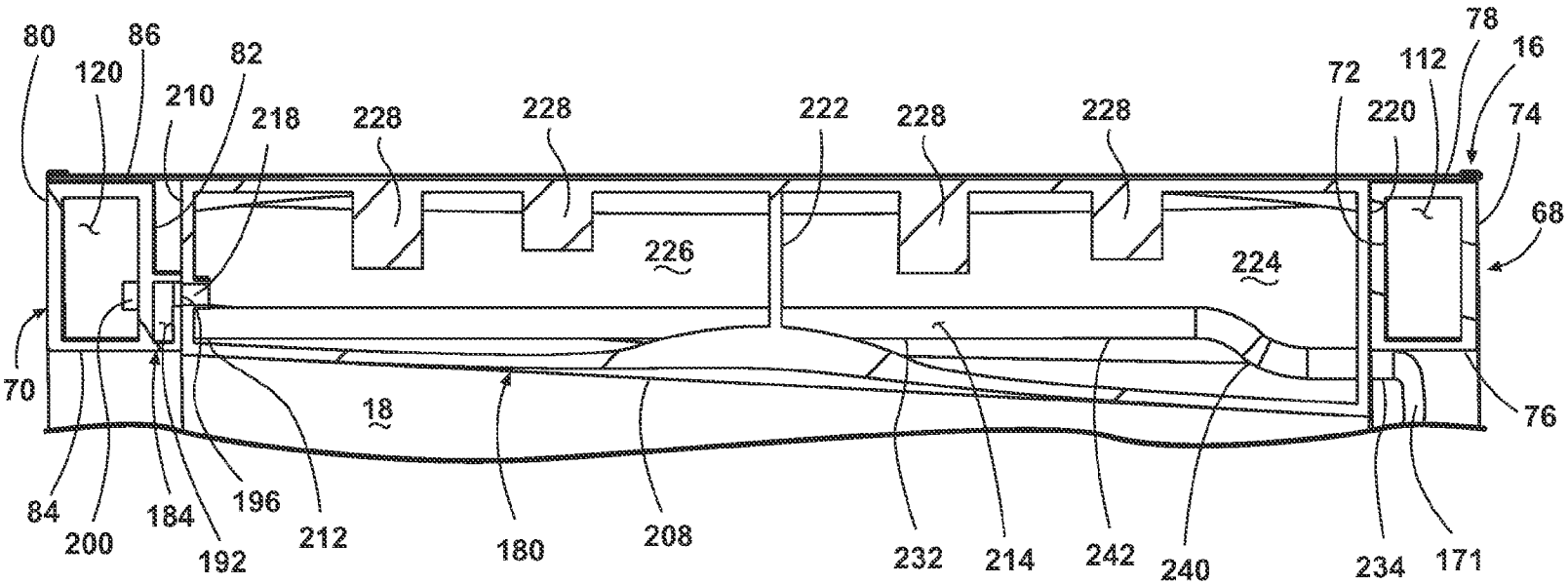
FIG. 15B is a close-up view of a portion of FIG. 9, illustrating a liquid drain path through one of the lifters of the drum of FIG. 9.

FIG. 15B is a close-up view of a portion of FIG. 9, illustrating a liquid drain path through one of the lifters of the drum of FIG. 9. Each of the front and rear reservoir chambers 224, 226 may define at least a portion of a drain conduit that fluidly couples one of the transfer conduits 192 in the transfer ring 184 to the tub 14 (FIG. 9). At the front end of the drum 16, the drain inlets 218, only one of which is visible in FIG. 15B, opening into the drain conduit defined by the lifter 180, are aligned with the outlet ports 196 in the transfer ring 184.

As shown in FIG. 15A, the drain conduit may extend generally an interior surface of the lifter 180 that may be defined by the top wall 208, through the passage 230, from the drain inlets 218 (FIG. 15B) to the drain outlet 238. The top wall 208 may be sloped to create an angled drain conduit, with one end of the top wall 208 radially closer to the rotational axis X of the drum 16 (FIG. 1) than the other end. When the lifter 180 is at or near a 12 o'clock position of the drum 16, whether the drum 16 is stationary or rotating at a low speed, liquid in the drain conduit naturally flows to the low end of the drain conduit by gravitational force. As illustrated, the drain outlet 238 may be radially closer to the rotational axis X of the drum 16 than the drain inlets 218.

As shown in FIG. 9, the rear reservoir chamber 224 has a first geometric center C1 that is closer to the rear end of the drum 16 than a midpoint M1 between the rear end of the drum 16 and the geometric center C of the drum 16. Likewise, the front reservoir chamber has a second geometric center C2 that is located closer to the front end of the drum 16 than a midpoint M2 between the front end of the drum 16 and the geometric center C of the drum 16. The apex of each wedge-shaped reservoir chamber 224, 226 is further directed toward the geometric center C of the drum 16. This configuration places the majority of the liquid closer to the ends and periphery of the drum 16, thereby optimizing the counterbalancing benefit of the lifters 180.

In operation, with reference to FIG. 9, when an imbalance in the drum 16 is detected by the sensor 106, the controller 108 determines what corrective action is needed to counterbalance the imbalance in the drum 16. This determination may include identifying one of the fluid chambers 112, 120 or one of the reservoir chambers 224, 226 to receive liquid to at least partially offset an imbalance in the rotating drum 16. The determination may further include identifying one of the reservoir chambers 224, 226 to receive liquid via one the fluid chambers 112, 120 to at least partially offset an imbalance in the rotating drum 16. Liquid from the household water supply 42 is directed to liquid channels 96 of the feeder 88 associated with the identified fluid chambers 112, 120 by opening the associated valves 102. This is done while the drum 16 and feeder 88 are rotating together, such that liquid is distributed along the liquid channel 96 of the feeder 88 by centrifugal force.

If liquid is to be directed to one of the fluid chambers 112 in the rear balancing ring 68, it may also be done in the same manner as described above for the first embodiment. Furthermore, if liquid is also to be directed to the rear reservoir chamber 224 in the lifter 180 associated with the fluid chamber 112, an increased amount of the liquid may be supplied to the fluid chamber 112. Once the liquid level in the fluid chamber 112 reaches the supply port 183, shown in FIG. 15A, liquid will begin to enter the rear reservoir chamber 224. Liquid entering the rear reservoir chamber 224 will be forced against the base wall 206 by centrifugal force, and away from the drain port 238.

Liquid may also be drained from the rear balancing ring 68 in much that same manner as described above for the first embodiment. Furthermore, when the lifter 180 is at or near a 12 o'clock position of the drum 16, whether the drum 16 is stationary or rotating at a low speed, liquid in the rear reservoir chamber 224 will flow along the inside of the top wall 208 and into the tub 14 through the drain outlet 238.

If liquid is to be directed to one of the fluid chambers 120 in the front balancing ring 68, liquid from the feeder 88 is supplied via the associated outlet conduit 104 to the supply conduit 214 of the associated lifter 180. The liquid passes through the supply conduit 214 and into the fluid chamber 120. This is also done while the drum 16, feeder 88, lifter 180, and front balancing ring 70 are rotating together, such that the liquid is forced outwardly from the feeder 88 and through the supply conduit 214 by centrifugal force. Furthermore, liquid entering the fluid chamber 120 will be forced against the outer wall 86 of the front balancing ring 70, away from the drain conduits 202 leading to the transfer ring 184.

If liquid is also to be directed to the front reservoir chamber 226 in the lifter 180 associated with the fluid chamber 120, an increased amount of the liquid may be supplied to the fluid chamber 112. Once the liquid level in the fluid chamber 120 reaches the supply passage 200, shown in FIG. 15A, liquid will begin to enter the front reservoir chamber 226. Liquid entering the front reservoir chamber 226 will be forced against the base wall 206 by centrifugal force, and away from the passage 230.

Figure 16:
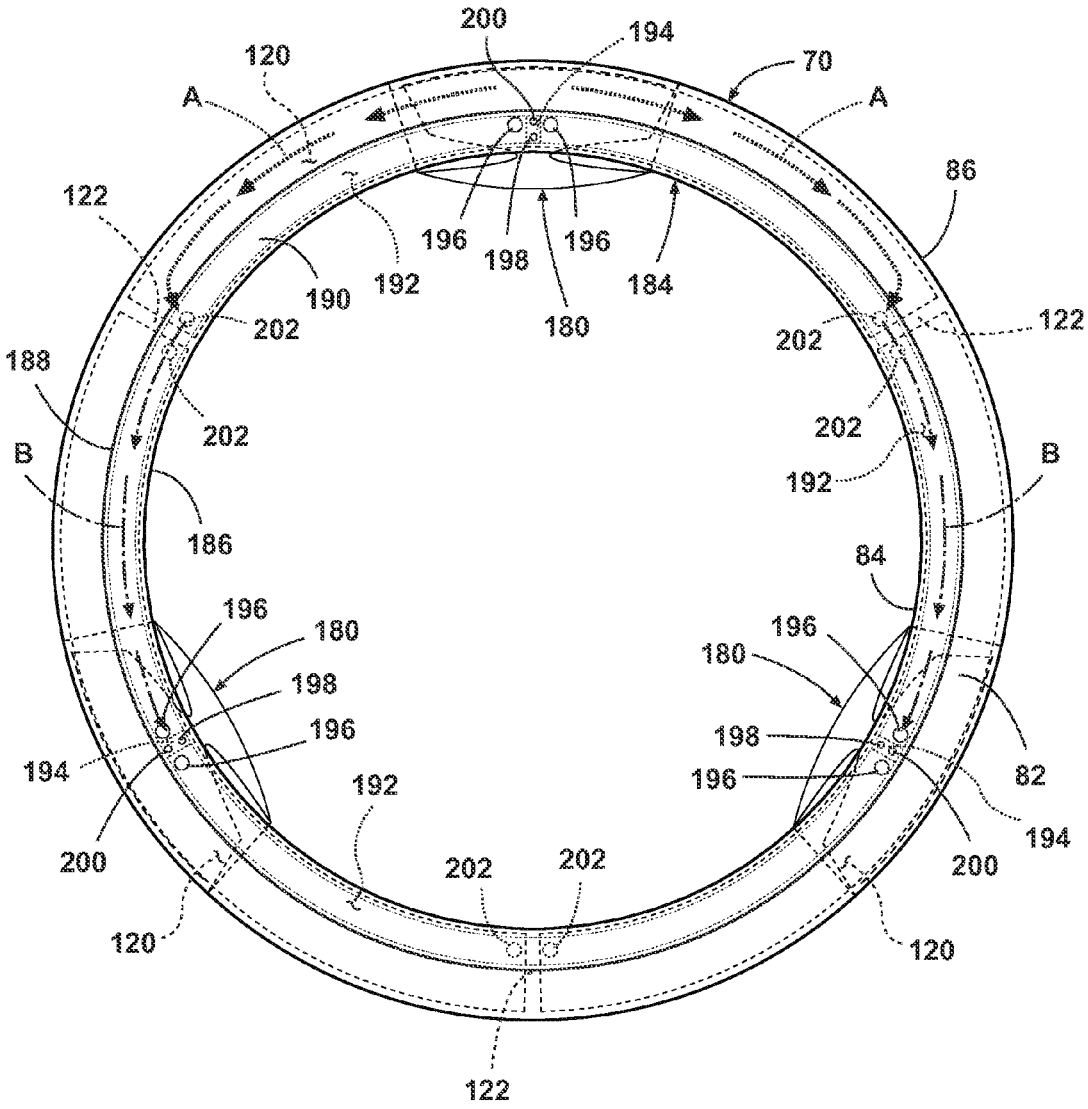
FIG. 16 is a rear view of the front balancing ring and lifters of the balancing system of FIG. 9, illustrating a liquid drain path through the front balancing ring.

FIG. 16 is a rear view of the front balancing ring 70 and lifters 180 of the balancing system 66 of FIG. 9, illustrating a liquid drain path through the front balancing ring 70. To drain liquid from one of the fluid chambers 120 in the front balancing ring 70, the drum 16 may be rotated until the fluid chamber 120 is at or near a 12 o'clock position of the drum 16, allowing liquid to flow out of the fluid chamber 120 through the drain conduits 202 and into the transfer conduit 192 in the transfer ring 184, as indicated by arrows A. Depending on the position of the lifter 180, liquid may drain into two transfer conduits 192. Due to the arrangement of the transfer ring, the lifter 180 that supplies liquid to a given fluid chamber 120 may not be utilized to drain the liquid from the fluid chamber 120. Instead, the two other lifters 180 are used to drain the liquid from the fluid chamber 120. Since the fluid chamber 120 is at or near a 12 o'clock position of the drum 16, the liquid flows to the lower point of the transfer conduits 192, which is near one of the dividing walls 194 and into the two other lifters 180 through the outlet ports 196, as indicated by arrows B. The lifter 180 may be mounted to the drum 16 with respect to the front balancing ring 70 such that the lifter 180 spans portions of two fluid chambers 120 and spans a portion of just one transfer conduit 192.

Referring back to FIG. 15A, the liquid will then flow along the inside of the top wall 208, through the passage 230, and into the tub 14 through the drain outlet 238. From the tub 14, the liquid may be drained via the liquid drain system 54. Furthermore, when the lifter 180 is at or near a 12 o'clock position of the drum 16, whether the drum 16 is stationary or rotating at a low speed, liquid in the front reservoir chamber 226 will flow along the inside of the top wall 208 and through the passage 230 into the rear reservoir chamber 224. From the rear reservoir chamber 224, the liquid will flow into the tub 14 through the drain outlet 238.

While the invention has been specifically described in connection with certain specific embodiments thereof, it is to be understood that this is by way of illustration and not of limitation. Reasonable variation and modification are possible within the scope of the forgoing disclosure and drawings without departing from the spirit of the invention which is defined in the appended claims.

What is claimed is:

1. A laundry treating appliance, comprising:

a cabinet defining an interior, a tub located within the interior and defining a liquid-holding chamber;

a drum located within the liquid-holding chamber for rotation about a rotational axis and having opposing ends connected by a peripheral side, which collectively at least partially define a treating chamber;

at least one lifter provided on the drum and projecting into the treating chamber; and a balancing system comprising:

a balancing ring provided on one of the opposing ends of the drum and having at least one fluid chamber;

a liquid supply system provided on the other of the opposing ends of the drum; and a tube extending through the at least one lifter and having:

a first end fluidly coupled to the liquid supply system and having a bottom wall, a center, and a top wall; and a second end fluidly coupled to the at least one fluid chamber and having a bottom wall, a center, and a top wall;

wherein at least one of the bottom wall, the center, and the top wall of the second end is radially farther from the rotational axis than a corresponding one of the bottom wall, the center, and the top wall of the first end such that liquid supplied to the first end will flow toward the second end in response to the centrifugal force applied to the liquid from the rotation of the drum;

wherein the at least one lifter defines an internal volume and the tube is provided within the internal volume of the at least one lifter.

2. The laundry treating appliance of claim 1 wherein the radial distance from the rotational axis to the tube increases along the length of the tube from the first end to the second end.

3. The laundry treating appliance of claim 1 wherein the radial distance from the rotational axis to the tube never decreases along the length of the tube from the first end to the second end.

4. The laundry treating appliance of claim 1 wherein the tube is generally straight from the first end to the second end.

5. A laundry treating appliance, comprising:

a cabinet defining an interior;

a tub located within the interior and defining a liquid-holding chamber;

a drum located within the liquid-holding chamber for rotation about a rotational axis and having opposing ends connected by a peripheral side, which collectively at least partially define a treating chamber;

at least one lifter provided on the drum and projecting into the treating chamber; and a balancing system comprising:

a balancing ring provided on one of the opposing ends of the drum and having at least one fluid chamber;

a liquid supply system provided on the other of the opposing ends of the drum; and a supply conduit extending through the at least one lifter and having:

a first end fluidly coupled to the liquid supply system and having a bottom wall, a center, and a top wall; and a second end fluidly coupled to the at least one fluid chamber and having a bottom wall, a center, and a top wall;

wherein at least one of the bottom wall, the center, and the top wall of the second end is radially farther from the rotational axis than a corresponding one of the bottom wall, the center, and the top wall of the first end such that liquid supplied to the first end will flow toward the second end in response to the centrifugal force applied to the liquid from the rotation of the drum;

wherein the supply conduit includes a first portion having a first central axis extending through the at least one lifter and a second portion having a second central axis extending through the at least one lifter, wherein the first central axis is more steeply angled than the second central axis relative to the rotational axis.

6. The laundry treating appliance of claim 5 wherein the first portion includes the first end and the second portion includes the second end.

7. The laundry treating appliance of claim 6 wherein the supply conduit comprises a tube provided within the at least one lifter.

8. The laundry treating appliance of claim 5 wherein the radial distance from the rotational axis to the supply conduit increases along the length of the supply conduit from the first end to the second end.

* * * * *